US009223272B2

(12) United States Patent
Asaka et al.

(10) Patent No.: US 9,223,272 B2
(45) Date of Patent: Dec. 29, 2015

(54) IMAGE FORMING APPARATUS

(71) Applicant: KYOCERA Document Solutions Inc., saka (JP)

(72) Inventors: Hitoshi Asaka, Osaka (JP); Katsuhiko Okamoto, Osaka (JP); Hiroki Matsui, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 14/252,291

(22) Filed: Apr. 14, 2014

(65) Prior Publication Data

US 2014/0321876 A1 Oct. 30, 2014

(30) Foreign Application Priority Data

Apr. 25, 2013 (JP) ..... 2013-092676
Apr. 25, 2013 (JP) ..... 2013-092691

(51) Int. Cl.
*G03G 15/00* (2006.01)

(52) U.S. Cl.
CPC ..... *G03G 15/50* (2013.01); *G03G 15/502* (2013.01); *G03G 2215/00949* (2013.01)

(58) Field of Classification Search
CPC ..... G03G 2215/00135; G03G 15/50; G03G 15/502; G03G 2215/00949
USPC ..... 399/82
See application file for complete search history.

(56) References Cited

U.S. PATENT DOCUMENTS

| | | | | |
|---|---|---|---|---|
| 6,614,546 | B1 | 9/2003 | Kurozasa | 358/1.15 |
| 2003/0231914 | A1* | 12/2003 | Yasui | 399/396 |
| 2007/0231034 | A1 | 10/2007 | Yasui | 399/401 |
| 2008/0003011 | A1 | 1/2008 | Unno | 399/82 |
| 2008/0240766 | A1 | 10/2008 | Sugihara | 399/81 |
| 2011/0199623 | A1 | 8/2011 | Okuyama | 358/1.9 |
| 2012/0013667 | A1 | 1/2012 | Snyder et al. | 347/16 |
| 2012/0051764 | A1 | 3/2012 | Kurita | 399/38 |
| 2012/0128386 | A1 | 5/2012 | Katayama et al. | 399/91 |
| 2013/0016121 | A1 | 1/2013 | Azuchi | 345/619 |
| 2015/0043931 | A1 | 2/2015 | Unno | 399/45 |

FOREIGN PATENT DOCUMENTS

| | | | |
|---|---|---|---|
| JP | H10-312251 | A | 11/1998 |
| JP | 2001-356646 | A | 12/2001 |
| JP | 2004-167798 | A | 6/2004 |
| JP | 2004-362608 | A | 12/2004 |
| JP | 2005-35107 | A | 2/2005 |
| JP | 2006-116885 | A | 5/2006 |
| JP | 2006-259147 | A | 9/2006 |
| JP | 2008-241963 | A | 10/2008 |
| JP | 2009-096624 | A | 5/2009 |
| JP | 2011-166781 | A | 8/2011 |

(Continued)

*Primary Examiner* — David Bolduc
*Assistant Examiner* — Barnabas Fekete
(74) *Attorney, Agent, or Firm* — Stein IP, LLC

(57) ABSTRACT

An image forming apparatus includes a job executing portion, a mode setting portion, and an operating portion. The operating portion accepts a function unit setting operation for setting a job executing mode in a function unit, the mode setting portion sets the job executing mode in the function unit based on the function unit setting operation accepted by the operating portion, and the job executing portion executes a job in the job executing mode set by the mode setting portion.

14 Claims, 17 Drawing Sheets

(56) References Cited

FOREIGN PATENT DOCUMENTS

| | | | |
|---|---|---|---|
| JP | 2012-20581 | A | 2/2012 |
| JP | 2012-108365 | A | 6/2012 |
| JP | 2012-233939 | A | 11/2012 |
| JP | 2012-254635 | A | 12/2012 |
| JP | 2013-20512 | A | 1/2013 |

* cited by examiner

IMAGE FORMING APPARATUS

CROSS-REFERENCE TO RELATED APPLICATIONS

This application is based on and claims the benefit of priority from Japanese Patent Application No. 2013-092676, filed on Apr. 25, 2013 and Japanese Patent Application No. 2013-092691, filed on Apr. 25, 2013, in the Japanese Patent Office. All disclosures of the document(s) named above are incorporated herein by reference.

BACKGROUND OF THE INVENTION

The present disclosure relates to an image forming apparatus that includes a job executing portion which executes jobs such as printing and the like.

Conventionally, an image forming apparatus is known, which has a plurality kinds of functions such as a scanning function, a printing function, a copying function and the like. In a job with the scanning function, a paper sheet is read to generate printing data. In a job with the printing function, printing is applied to a paper sheet based on printing data transmitted from an external apparatus. In a job with the copying function, printing is applied to a paper sheet based on printing data obtained by reading a document.

As job executing portions disposed in such an image forming apparatus, there are a feeding portion for feeding a paper sheet, an image forming portion for forming an image and the like. And, the job executing portion is driven by driving force transmitted from a motor to execute a job. Because of this, during a job executing time, a rotation sound of the motor and a driving sound of the job executing portion are released, which a user is likely to feel uncomfortable.

Accordingly, conventionally, an image forming apparatus is proposed, which incorporates two job executing modes of a usual mode for executing a job at a predetermined processing speed and a quiet-sound mode for raising quietness during a job executing time by executing a job at a processing speed slower than in the usual mode.

If the job executing mode is set or changed, the conventional image forming apparatus executes all jobs in the job executing mode after being set or changed even in a case where any one of the plurality of kinds of functions is used. However, there is a case where some users want to execute a job in the quiet-sound mode when using a predetermined function of the plurality of kinds of functions and want to execute a job in the usual mode when using a function other than the predetermined function. In such a case, if the job executing mode is changed and set to the quiet-sound mode when using the predetermined function, the job executing mode must be returned to the usual mode when using a function other than the predetermined function. Because of this, operations (operations for changing and setting the job executing mode) performed by the user increase; accordingly, convenience for the user deteriorates.

Besides, upon receiving a command for executing a job from the user, the conventional image forming apparatus starts the job in the job executing mode that is already set before starting the job. In the meantime, "before starting the job" is, for example, "before reading a document" or "before receiving printing data." And, until the job ends, the job executing mode previously set is held and the job executing mode is not changed.

Here, there are cases where some users want to change the job executing mode during a job executing period when a job is under execution or during a job standby period when a job is on standby. For example, the cases include: a case where the user knows, after a job is started, that the quiet-sound mode is set even if the user wants to end the job rapidly; a case where an unexpectedly large sound is released from the image forming apparatus during a time when the job is executed in the usual mode and the like. However, even in such cases, in the conventional image forming apparatus, if a job is started, it is impossible to change the job executing mode. Accordingly, it is inconvenient for the user.

SUMMARY OF THE INVENTION

The present disclosure has been made to solve the above problems, and it is an object of the present disclosure to provide an image forming apparatus which incorporates two job executing modes of a usual mode and a quiet-sound mode, and is able to improve the convenience for a user by reducing operations performed by the user (operations for setting and changing job executing modes).

It is another object of the present disclosure to provide an image forming apparatus which incorporates two job executing modes of a usual mode and a quiet-sound mode, and is able to improve the convenience for a user by enabling the job executing mode to be changed during at least one period of a job executing period and a job standby period.

An image forming apparatus according to a first aspect of the present disclosure is an image forming apparatus that incorporates two job executing modes of: a usual mode for executing a job at a predetermined usual processing speed; and a quiet-sound mode for raising quietness during a time of executing a job by executing a job at a quiet-sound processing speed slower than the usual processing speed, the image forming apparatus comprises a job executing portion, a mode setting portion, and an operating portion. The job executing portion executes jobs of a plurality of kinds of functions, uses the usual processing speed as a processing speed in the usual mode, and uses the quiet-sound processing speed as a processing speed in the quiet-sound mode. The mode setting portion sets in which one of the job executing modes of the usual mode and the quiet-sound mode to execute a job. The operating portion accepts an operation for setting the job executing mode. And, the operating portion accepts a function unit setting operation for setting the job executing mode in a function unit; when the operating portion accepts the function unit setting operation, the mode setting portion sets the job executing mode in the function unit based on the function unit setting operation accepted by the operating portion, and the job executing portion executes a job in the job executing mode set by the mode setting portion.

An image forming apparatus according to a second aspect of the present disclosure is an image forming apparatus that incorporates two job executing modes of: a usual mode for executing a job at a predetermined usual processing speed; and a quiet-sound mode for raising quietness during a time of executing a job by executing the job at a quiet-sound processing speed slower than the usual processing speed, the image forming apparatus comprises a job executing portion, a mode setting portion, and an operating portion. The job executing portion executes a job at the usual processing speed in the usual mode and executes a job at the quiet-sound processing speed in the quiet-sound mode. The mode setting portion sets in which one of the job executing modes of the usual mode and the quiet-sound mode to execute a job. The operating portion accepts an operation for setting the job executing mode. And, during at least one period of a job executing period when an executing target job is under execution and a job standby period when the executing target job is on standby, the operating portion accepts a job unit setting operation for setting, in a unit of the executing target job, the job executing mode of the executing target job that is at least one job of a job under execution and a standby job; when the operating portion accepts the job unit setting operation, the mode setting portion sets the job executing mode in the unit of the executing target job based on the job unit setting operation accepted by the operating portion, and the job executing portion executes a job in the job executing mode set by the mode setting portion.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

An image forming apparatus according to the present embodiment is described exemplifying a multi-function machine that has a plurality of kinds of functions such as a scanning function, a printing function, a copying function and the like.

(Whole Structure of Image Forming Apparatus)

Figure 1:
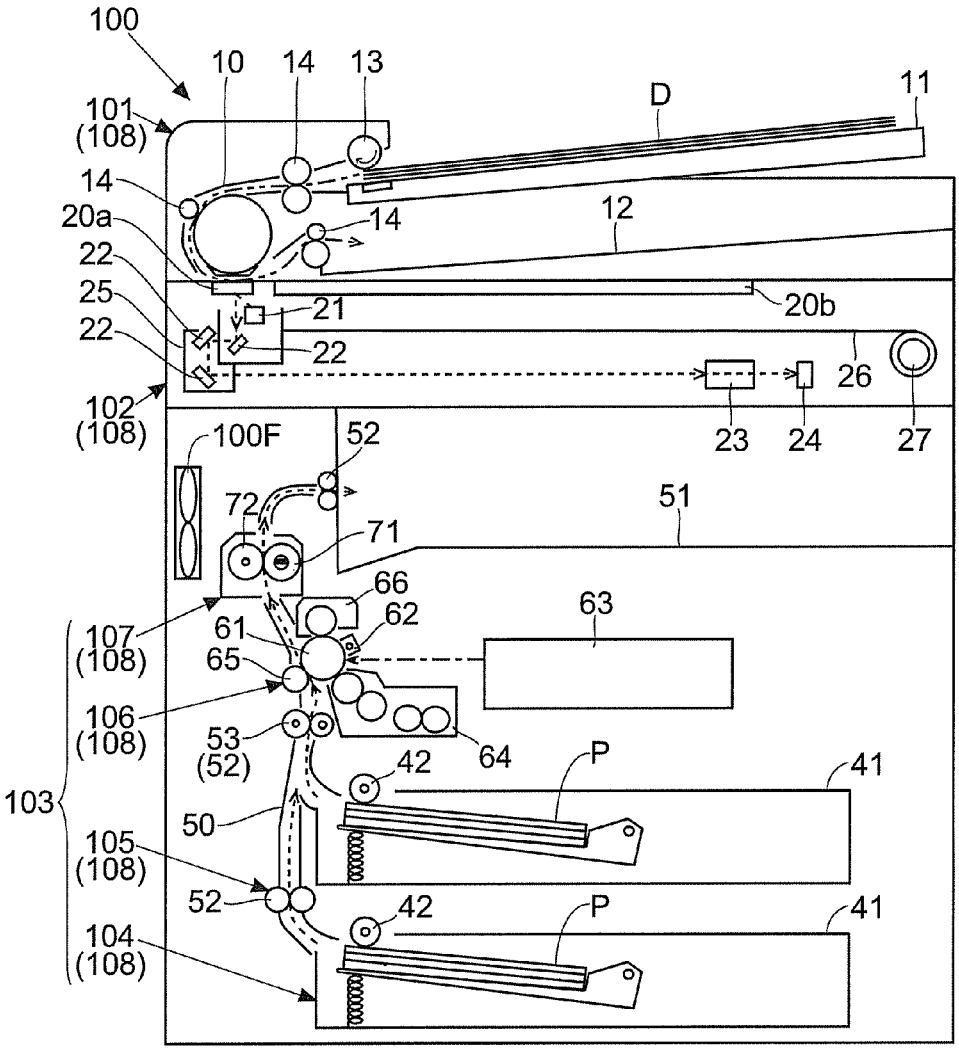
FIG. 1 is a whole structural view of an image forming apparatus according to an embodiment of the present disclosure.

As shown in FIG. 1, an image forming apparatus 100 includes a document feeding portion 101, an image reading portion 102, and an engine portion 103 (paper sheet supplying portion 104, paper sheet feeding portion 105, image forming portion 106 and fixing portion 107).

The document feeding portion 101 and the image reading portion 102 are job executing portions for achieving the scanning function. The engine portion 103 is a job executing portion for achieving the printing function. The copying function is a multi-function that is achieved by a combination of the scanning function and the printing function. In the following description, there is a case where the document feeding portion 101, the image reading portion 102, and the engine portion 103 are collectively called a job executing portion 108.

The document feeding portion 101 supplies a document D set on a paper sheet supplying tray 11 to a paper sheet feeding path 10, thereafter, feeds the document D to a feeding-and-reading position, and ejects the document D to an ejecting tray 12. The document feeding portion 101 is provided with: a paper sheet supplying roller 13 for supplying the document D to the document feeding path 10; and a plurality of pairs of feeding rollers 14 for feeding the document D along the document feeding path 10.

The image reading portion 102 reads the document D fed on a feeding-and-reading contact glass 20*a* (feeding-and-reading position) or the document D placed on a placing-and-reading contact glass 20*b* to generate image data of the document D. The image reading portion 102 is provided with a reading mechanism that is composed of a lamp 21, a mirror 22, a lens 23, a line sensor 24 and the like.

The lamp 21 and the mirror 22 are held by a holding member 25 that is movably disposed in a sub-scan direction that meets a main scan direction (direction perpendicular to the paper surface of FIG. 1) at right angles. The holding member 25 is linked to one end of a wire 26. The other end of the wire 26 is linked to a winding drum 27 that rotates to wind the wire 26. In the meantime, a plurality of wires 26 are linked to the holding member 25 and a plurality of wires 26 are mounted on the holding member 25. However, in FIG. 1, only one wire 26 is illustrated for the sake of convenience.

When the winding drum 27 rotates, the holding member 25 moves in the sub-scan direction. And, the reading of the document D fed on the contact glass 20*a* is performed with the holding member 25 moved under the contact glass 20*a*. The reading of the document D placed on the contact glass 20*b* is performed with the holding member 25 being moved in the sub-scan direction under the contact glass 20*b*.

The paper sheet supplying portion 104 has a paper sheet supplying cassette 41 and supplies a paper sheet P stored in the paper sheet supplying cassette 41 to a paper sheet feeding path 50. The paper sheet supplying portion 104 is provided with a paper sheet supplying roller 42 for supplying the paper sheet P to a paper sheet feeding path 50. In the meantime, the image forming apparatus 100 includes a plurality of stages of paper sheet supplying portions 104 that are stacked and disposed in a vertical direction. However, only one stage of paper sheet supplying portion 104 may be disposed in the image forming apparatus 100.

The paper sheet feeding portion 105 feeds the paper sheet P supplied to the paper sheet feeding path 50 through a transferring nip and a fixing nip sequentially in this order and ejects the paper sheet P to an ejecting tray 51. The paper sheet feeding portion 105 is provided with a plurality of pairs of feeding rollers 52 for feeding the paper sheet P along the paper sheet feeding path 50. One pair of feeding rollers 52 of the plurality of pairs of feeding rollers 52 are a pair of registration rollers 53. The pair of registration rollers 53 make the paper sheet P wait before the transferring nip and synchronizes with timing to send the paper sheet to the transferring nip.

The image forming portion 106 forms a toner image based on image data (e.g., image data obtained by reading the image reading portion 102) and transfers the toner image onto the paper sheet P. The image forming portion 106 includes a photosensitive drum 61, an charging device 62, an exposing device 63, a developing device 64, a transferring roller 65, and a cleaning device 66.

During an image forming time, the photosensitive drum 61 rotates, and the charging device 62 electrifies a surface of the photosensitive drum 61 to a predetermined potential. Besides, the exposing device 63 has a light emitting device (not shown) that emits light for exposure, turns on and off the light emitting device based on the image data to apply scanning and exposing to the surface of the photosensitive drum 61. In this way, an electrostatic latent image is formed on the surface of the photosensitive drum 61. The developing device 64 supplies toner to the electrostatic latent image formed on the surface of the photosensitive drum 61 to develop the image.

The transferring roller 65 comes into tight contact with the surface of the photosensitive drum 61 to form the transferring nip with the photosensitive drum 61. In this state, the pair of registration rollers 53 synchronize with timing to make the paper sheet P go into the transferring nip. At this time, a transferring voltage is applied to the transferring roller 65. In this way, the toner image on the surface of the photosensitive drum 61 is transferred onto the paper sheet P. After the transfer of the toner image onto the paper sheet P ends, the cleaning device 66 removes toner and the like remaining on the surface of the photosensitive drum 61.

The fixing portion 107 heats and pressurizes the toner image transferred to the paper sheet P to fix the toner image. The fixing portion 107 includes a heating roller 71 and a pressurizing roller 72. The heating roller 71 incorporates a heat generating source. The pressurizing roller 72 comes into tight contact with the fixing roller 71 to form the fixing nip with the heating roller 71. And, the paper sheet P on which the toner image is transferred passes through the fixing nip to be heated and pressurized. In this way, the toner image is fixed to the paper sheet P. The printed paper sheet P is sent to the ejecting tray 51 by the pair of feeding rollers 52.

Figure 2:
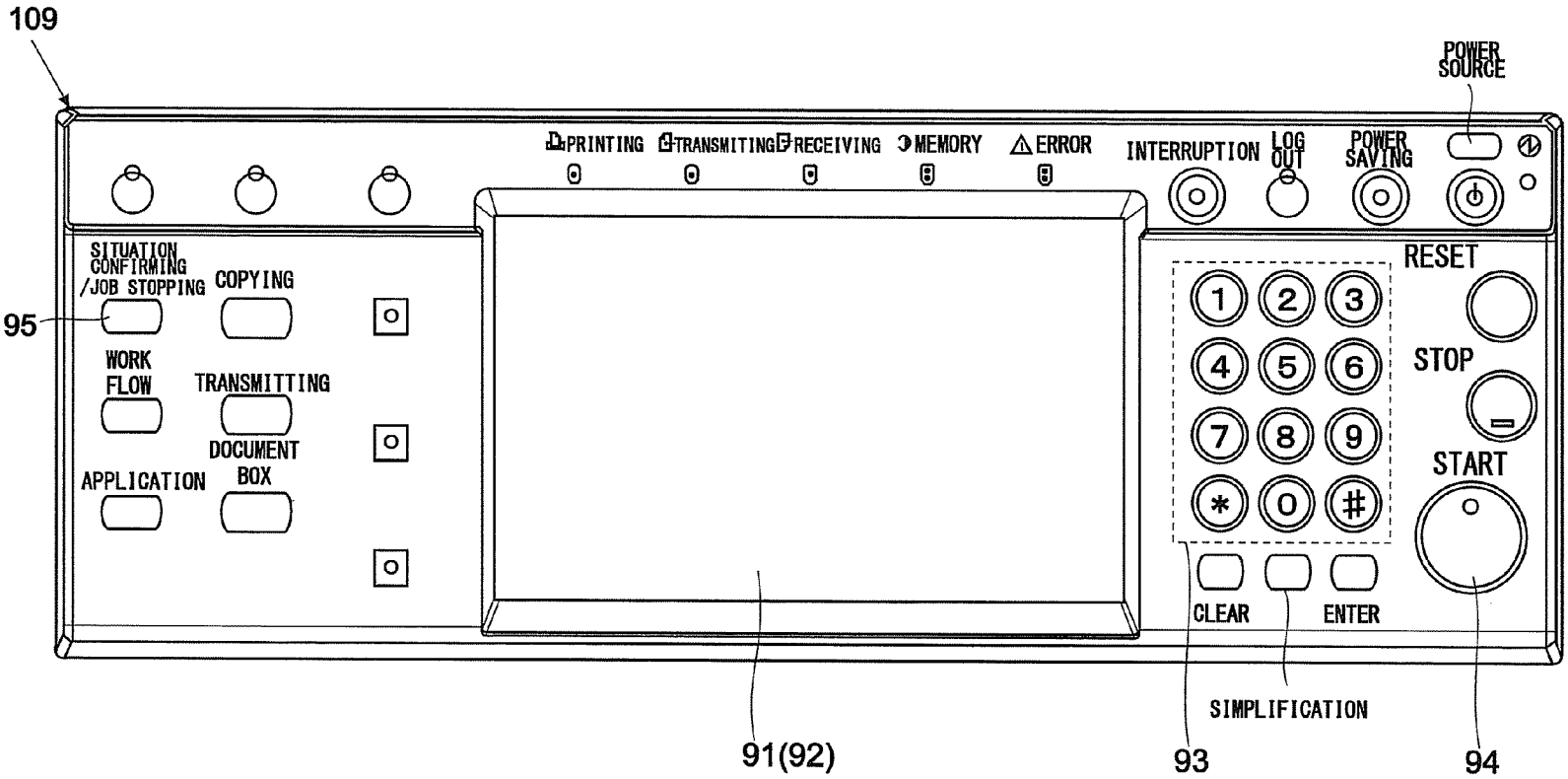
FIG. 2 is a front view of an operating panel (operating portion) disposed in the image forming apparatus shown in FIG. 1.

Besides, the image forming apparatus 100 includes an operating panel 109 as shown in FIG. 2. The operating panel 109 includes a liquid crystal display portion 91. The liquid crystal display portion 91 is a display portion provided with a touch panel in which a touch panel portion 92 is disposed on a display surface. The liquid crystal display portion 91 displays a soft key for accepting various settings, a message and the like. Further, the operating panel 109 is also provided with hard keys such as a ten key pad 93, a starting key 94, a situation confirming key 95 and the like.

Back to FIG. 1, the image forming apparatus 100 includes a fan 100F. The fan 100F circulates air in the image forming apparatus 100 during a job executing time to cool an inside of the image forming apparatus 100.

(Hardware Structure of Image Forming Apparatus)

Figure 3:
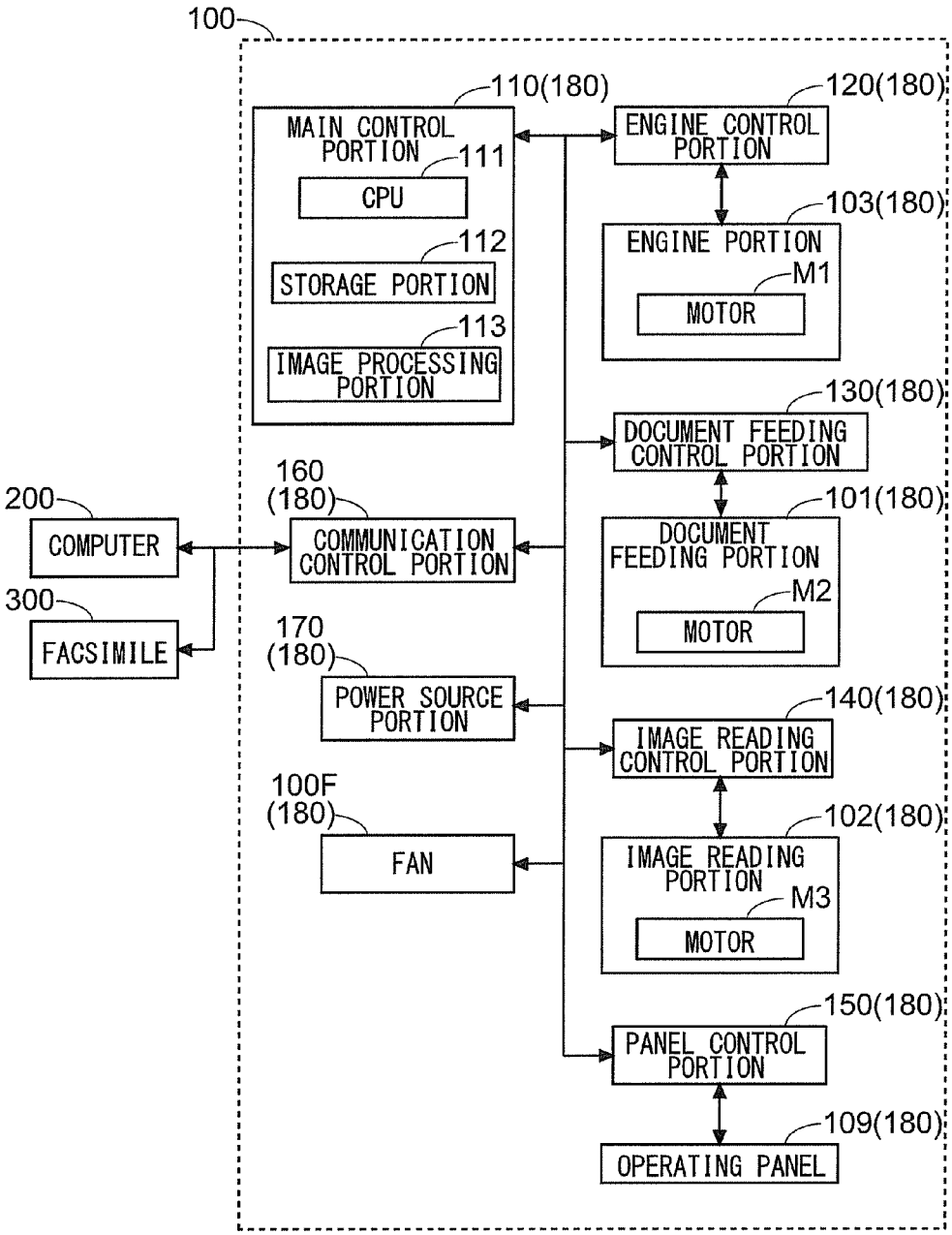
FIG. 3 is a block diagram for describing a hardware structure of the image forming apparatus shown in FIG. 1.

As shown in FIG. 3, the image forming apparatus 100 includes a main control portion 110 that performs whole control of the image forming apparatus 100. The main control portion 110 includes a CPU 111, a storage portion 112, and an image processing portion 113 and the like. The storage portion 112 includes a ROM, a RAM, a HDD and the like; for example, a program and data necessary for job execution are stored in the ROM, and these program and data are deployed in the RAM. The image processing portion 113 includes an ASIC dedicated to image processing and the like, and applies various image processings (enlargement/reduction, density change, data format change and the like) to image data.

The main control portion 110 is connected to an engine control portion 120. The engine control portion 120 receives an instruction from the main control portion 110 to control the printing operation of the engine portion 103 (paper sheet supplying portion 104, paper sheet feeding portion 105, image forming portion 106, and fixing portion 107). For example, the engine control portion 120 controls driving of a motor M1 for rotating various rotators of the engine portion 103 to suitably rotate the various rotators of the engine portion 103.

In the meantime, the motor M1 is a paper sheet feeding motor, an image forming motor, a fixing motor and the like. The paper sheet feeding motor is a motor for rotating various rotators (pair of feeding rollers 52 and the like) that are disposed in the paper sheet supplying portion 104 and the paper sheet feeding portion 105 and used for paper sheet feeding. The image forming motor is a motor for rotating various rotators (photosensitive drum 61 and the like) that is disposed in the image forming portion 106 and used for image forming. The fixing motor is a motor for rotating various rotators (heating roller 71 and the like) that are disposed in the fixing portion 107 and used for fixing.

Besides, the main control portion 110 is connected to a document feeding control portion 130. The document feeding control portion 130 receives an instruction from the main control portion 110 to control a document feeding operation of the document feeding portion 101. For example, the document feeding control portion 130 controls driving of a motor M2 for rotating the paper sheet supplying roller 13 and the pair of feeding rollers 14 to suitably rotate the paper sheet supplying roller 13 and the pair of feeding rollers 14.

Besides, the main control portion 110 is connected to an image reading control portion 140. The image reading control portion 140 receives an instruction from the main control portion 110 to control an image reading operation of the image reading portion 102. For example, the image reading control portion 140 controls driving of a motor M3 for rotating the winding drum 27 to suitably rotate the winding drum 27 (suitably move the holding member 25 in the sub-scan direction).

Besides, the main control portion 110 is connected to a panel control portion 150. The panel control portion 150 receives an instruction from the main control portion 110 to control a display operation of the operating panel 109. Further, also the panel control portion 150 performs detection of an operation fulfilled on the operating panel 109. In other words, if a soft key displayed on the liquid crystal display portion 91 is touched, the panel control portion 150 detects a touch position (detects the touched soft key) based on an output from the touch panel portion 92. Further, if a hard key (ten-key pad 93, start key 94, situation conforming key 95 and the like) is pushed down, the panel control portion 150 detects the hard key pushed down. Upon detecting an operation performed on the operating panel 109, the panel control portion 150 transmits the detection result to the main control portion 110. In this way, the main control portion 110 recognizes the operation performed on the operating panel 109.

Besides, the main control portion 110 is connected to a communication control portion 160. For example, the communication control portion 160 is communicably connected to an external computer 200 via a network. In this way, it is possible to perform printing based on image data transmitted from the computer 200 and also transmit the image data obtained by reading the document D to the computer 200. Besides, the communication control portion 160 may incorporate a modem and the like. In this case, it is possible to communicate with an external facsimile 300 via a network such as a telephone line or the like.

Besides, the main control portion 110 is connected to a power source portion 170. The power source portion 170 is connected to a commercial power source to generate a voltage necessary to operate the image forming apparatus 100. And, the power source portion 170 performs power supply for the job executing portion 108, the operating panel 109, and respective control portions (main control portion 110, engine control portion 120, document feeding control portion 130, image reading control portion 140, panel control portion 150, and communication control portion 160) that are power supplied portions. Hereinafter, there is a case where the respective portions, which receive the power supply from the power source 170 to operate, are collectively called a power supplied portion 180.

Here, the image forming apparatus 100 incorporates a usual power mode and a power saving mode (sleep mode) as power modes relevant to the power supply for the power supplied portion 180. The usual power mode is a mode for performing usual power supply for the power supplied portion 180. The power saving mode is a mode for imposing more restriction on the power supply for the power supplied portion 180 than in the usual power mode.

When in the usual power mode, the power source portion 170 supplies power to all the portions of the power supplied portion 180. On the other hand, when shifting from the usual power mode to the power saving mode, the power source portion 170 supplies power to only a part of the power supplied portion 180 and stops the power supply for the other parts.

If a shift condition from the usual power mode to the power saving mode is satisfied, the main control portion 110 shifts the usual power mode to the power saving mode. For example, the main control portion 110 counts a not-used time that is an elapsing time during which the image forming apparatus 100 is not used, and in a case where the not-used time of the image forming apparatus 100 exceeds a predetermined threshold time, the main control portion 110 shifts the usual power mode to the power saving mode regarding that the shift condition is satisfied. Or, also in a case where the operating panel 109 receives an instruction for shifting from the usual power mode to the power saving mode, the main control portion 110 shifts the usual power mode to the power saving mode regarding that the shift condition is satisfied.

And, when the power source portion 170 receives a return signal from a return condition detecting portion indicating that a return condition from the power saving mode to the usual power mode is satisfied, the power source portion 170 resumes the power supply for all the parts of the power supplied portion 180 (returns them from the power saving mode to the usual power mode). In the meantime, the power source portion 170 receives the return signal from the return condition detecting portion; accordingly, even in the power saving mode, the power source portion continues the power supply for the return condition detecting portion.

As a portion corresponding to the return condition detecting portion, there is the operating panel 109. For example, upon being operated when in the power saving mode, the operating panel 109 transmits the return signal to the power source portion 170. Besides, the communication control portion 160 also functions as the return condition detecting portion. Upon receiving data from the computer 200 and the facsimile 300 when in the power saving mode, the communication control portion 160 transmits the return signal to the power source portion 170.

Further, although not shown, a sensor for detecting opening and closing of an apparatus cover mounted on the image forming apparatus 100, a sensor for detecting opening and closing of the document feeding portion 101 with respect to the image reading portion 102, a sensor for detecting the document D being set on the document setting tray 11, and a sensor for detecting mounting and demounting of the paper sheet supplying cassette 41 and the like also function as the return condition detecting portion. In other words, in the power saving mode, when the apparatus cover and the document feeding portion 101 are opened and closed, the document D is set on the document setting tray 11, or the paper sheet supplying cassette 41 is mounted and demounted, the power source portion 170 returns from the power saving mode to the usual power mode.

Besides, the main control portion 110 is connected to the fan 100F to control driving of the fan 100F. For example, the main control portion 110 drives the fan 100F during a time of executing a job. And, after the job ends, the main control portion 110 stops the driving of the fan 100F after a predetermined time elapses. In the meantime, the fan 100F also is the power supplied portion 180.

(Overview of Job Executing Mode (Usual Mode and Quiet-Sound Mode))

The image forming apparatus 100 incorporates two job executing modes of a usual mode for executing a job at a predetermined usual processing speed and a quiet-sound mode for raising quietness during a job executing time by executing a job at a quiet-sound processing speed lower than the usual processing speed. In other words, the job executing portion 108 executes a job at the usual processing speed in the usual mode and executes a job at the quiet-sound processing speed in the quiet-sound mode.

In the scanning function, if the job executing mode is set to the usual mode, a feeding speed of the document D fed by the document feeding portion 101 becomes a predetermined usual speed. On the other hand, if the job executing mode is set to the quiet-sound mode, the feeding speed of the document D becomes slower than in the usual mode. In other words, in the case where the job executing mode is set to the quiet-sound mode, the document feeding control portion 130 makes a rotation speed of the motor M2 slower than in the usual mode. For example, the feeding speed of the document D is switchable in three steps. And, the document feeding control portion 130 sets the rotation speed of the motor M2 to the highest of the three steps in the usual mode and sets the rotation speed of the motor M2 to the lowest of the three steps in the quiet-sound mode.

In the printing function, if the job executing mode is set to the usual mode, a feeding speed of the paper sheet P fed by the engine portion 103 becomes a predetermined usual speed. On the other hand, if the job executing mode is set to the quiet-sound mode, the feeding speed of the paper sheet P becomes slower than in the usual mode. In other words, in the case where the job executing mode is set to the quiet-sound mode, the engine control portion 120 makes a rotation speed of the motor M1 slower than in the usual mode. For example, the engine control portion 120 sets the rotation speed of the motor M1 in the quiet-sound mode to 50% of the rotation speed of the motor M1 in the usual mode.

In the copying function that is a combined function of the printing function and the scanning function, if the job executing mode is set to the usual mode, the feeding speeds the document D and paper sheet P become the usual speeds. On the other hand, if the job executing mode is set to the quiet-sound mode, the feeding speeds of the document D and paper sheet P become slower than in the usual mode.

As described above, in the quiet-sound mode, the rotation speeds of the motor M1 and motor M2 become slow; accordingly, rotation sounds of the motor M1 and motor M2 become smaller than in the usual mode, and also driven sounds of respective driven portions that are driven by driving forces conducted from the motor M1 and motor M2 become smaller than in the usual mode. Besides, if the feeding speed of the paper sheet P becomes slow, a sliding sound caused by rubbing between the paper sheet P and the paper sheet feeding path 50 becomes small, while if the feeding speed of the document D becomes slow, a sliding sound caused by rubbing between the document D and the document feeding path 10 becomes small. Accordingly, in the quiet-sound mode, a sound level released from the inside of the image forming apparatus 100 becomes lower than in the usual mode. In other words, the quietness rises.

The main control portion 110 sets in which job executing mode of the usual mode and the quiet-sound mode to execute a job. In other words, the main control portion 110 corresponds to a "mode setting portion" of the present disclosure.

For example, the storage portion 112 stores either one of the usual mode and the quiet-sound mode as a default mode. And, at a startup time of the image forming apparatus 100, the main control portion 110 sets the default mode stored in the storage portion 112 as the job executing mode. In the meantime, the startup time of the image forming apparatus 100 includes not only a time when a main power source for the image forming apparatus 100 is turned on but also a time of returning from the power saving mode to the usual power mode.

(Setting of Job Executing Mode in Function Unit)

Figure 4:
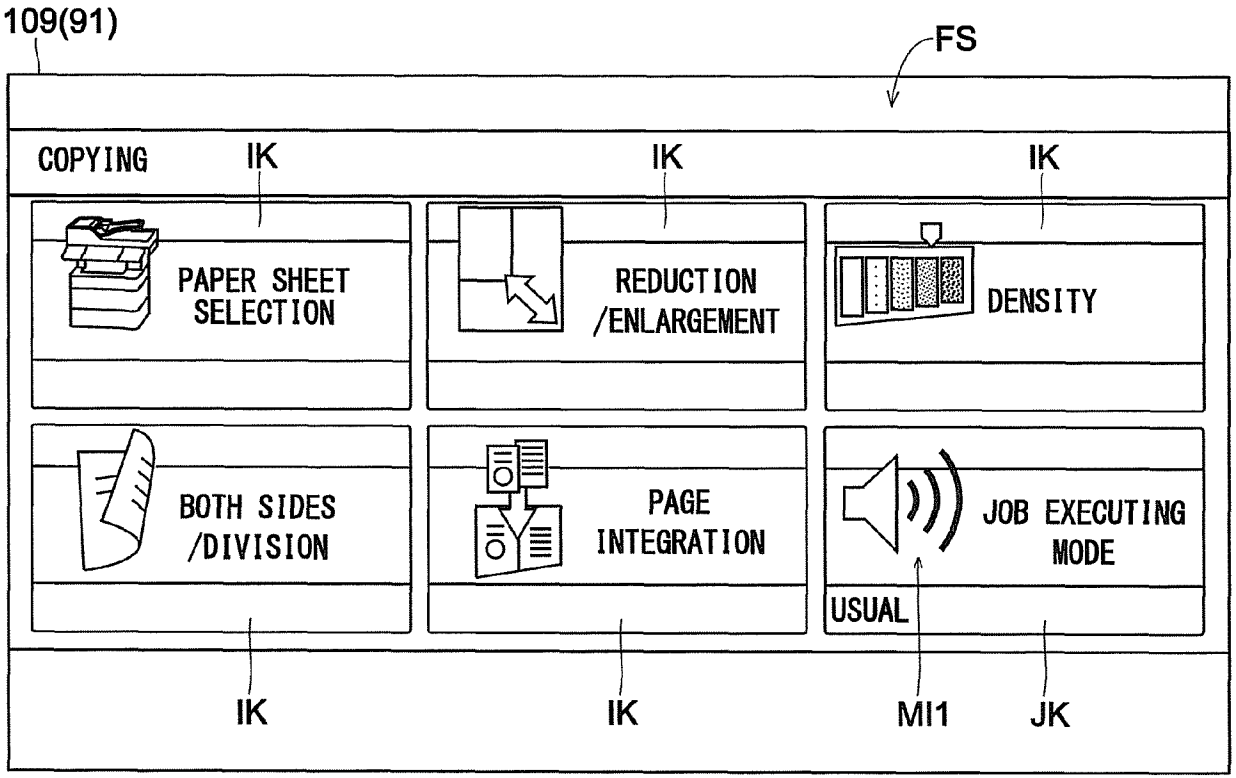
FIG. 4 is a view of a screen displayed on the operating panel of the image forming apparatus shown in FIG. 1.

The operating panel 109 makes the liquid crystal display portion 91 display a function screen FS as shown in FIG. 4 for each of a plurality of kinds of functions. In the meantime, as an example, FIG. 4 shows the function screen FS for the copying function.

A setting item key IK, which indicates a setting item whose setting value is variable in a corresponding function, is displayed in the function screen FS. For example, the function screen FS for the copying function displays the setting item keys IK for respective setting items such as paper sheet selection, reduction/enlargement, density, both sides/division, page integration and the like. Besides, the current-time set value for a corresponding setting item is represented on the setting item keys IK. And, if the setting item key IK is touched, the operating panel 109 makes the liquid crystal display portion 91 display a screen (not shown) for setting or changing the set value for the setting item that corresponds to the touched setting item key IK. In this way, the user can recognize the current-time set value, set or change the set value.

Besides, also a job executing mode key JK is displayed in the function screen FS. If the job executing mode key JK is touched, the operating panel 109 makes the liquid crystal display portion 91 display a job executing mode setting screen JS (see FIG. 5) for setting or changing the job executing mode. In the meantime, the job executing mode setting screen JS is a screen that accepts a function unit setting operation for setting the job executing mode for the plurality of kinds of functions in a function unit. In other words, the operating panel 109 corresponds to an "operating portion" of the present disclosure and accepts the function unit setting operation.

Figure 5:
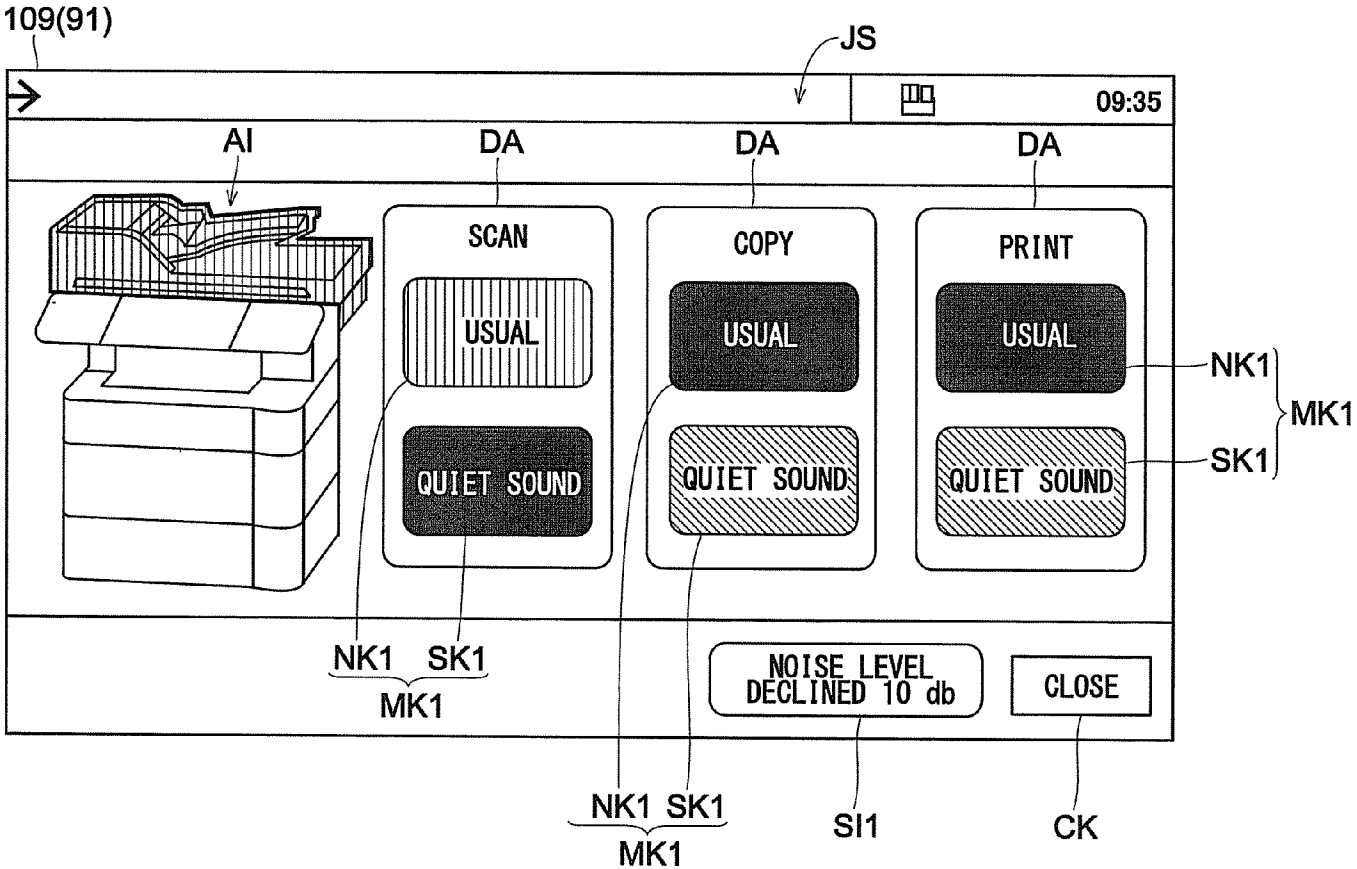
FIG. 5 is a view of a screen (screen for acceptance of setting and changing a job executing mode in a function unit) displayed on the operating panel of the image forming apparatus shown in FIG. 1.

A plurality of display regions DA, each of which corresponds to each of the plurality of kinds of functions, exist in the job executing mode setting screen JS as shown in FIG. 5. Each of the plurality of display regions DA displays a text that indicates a corresponding function. For example, the display region DA corresponding to the scanning function displays a text "scan," the display region DA corresponding to the copying function displays a text "copy," and the display region DA corresponding to the printing function displays a text "print."

The plurality of display regions DA each display one mode setting key MK1 that has a usual mode key NK1 and a quiet-sound mode key SK1. In other words, the operating panel 109 displays the mode setting key MK1 for each of the plurality of kinds of functions. The mode setting key MK1 displayed in the display region DA for the scanning function is a key for acceptance of setting or changing of the job executing mode for the scanning function, the mode setting key MK1 displayed in the display region DA for the copying function is a key for acceptance of setting or changing of the job executing mode for the copying function, and the mode setting key MK1 displayed in the display region DA for the printing function is a key for acceptance of setting or changing of the job executing mode for the printing function. Besides, the usual mode key NK1 is a key for setting or changing the job executing mode to the usual mode, while the quiet-sound mode key SK1 is a key for setting or changing the job executing mode to the quiet-sound mode.

If the mode setting key MK1 is touched, the operating panel 109 accepts the touch operation as a function unit setting operation. And, when the operating panel 109 accepts the function unit setting operation, the main control portion 110 sets or changes the job executing modes for the plurality of kinds of functions in the function unit.

Specifically, when the function unit setting operation is performed on the mode setting key MK1, if the usual mode key NK1 is an operating target, the main control portion 110 sets or changes the job executing mode for a predetermined function corresponding to the mode setting key MK1, on which the function unit setting operation is performed, to the usual mode. On the other hand, when the function unit setting operation is performed on the mode setting key MK1, if the quiet-sound mode key SK1 is an operating target, the main control portion 110 sets or changes the job executing mode for a predetermined function corresponding to the mode setting key MK1, on which the function unit setting operation is performed, to the quiet-sound mode. At this time, the main control portion 110 does not change the job executing mode for a function other than the predetermined function to keep the previous setting.

For example, it is assumed that the function unit setting operation is performed on the mode setting key MK1 corresponding to the scanning function. In this case, if the usual mode key NK1 is an operating target, the main control portion 110 sets or changes the job executing mode for the scanning function to the usual mode (sets the feeding speed of the document D to the usual speed). On the other hand, if the quiet-sound mode key SK1 is an operating target, the main control portion 110 sets or changes the job executing mode for the scanning function to the quiet-sound mode (sets the feeding speed of the document D to a speed slower than the usual speed). And, the main control portion 110 does not change the job executing modes for the copying function and the printing function to keep the previous settings.

Besides, it is assumed that the function unit setting operation is performed on the mode setting key MK1 corresponding to the printing function. In this case, if the usual mode key NK1 is an operating target, the main control portion 110 sets or changes the job executing mode for the printing function to the usual mode (sets the feeding speed of the paper sheet P to the usual speed). On the other hand, if the quiet-sound mode key SK1 is an operating target, the main control portion 110 sets or changes the job executing mode for the printing function to the quiet-sound mode (sets the feeding speed of the paper sheet P to a speed slower than the usual speed). And, the main control portion 110 does not change the job executing modes for the scanning function and the copying function to keep the previous settings.

Besides, it is assumed that the function unit setting operation is performed on the mode setting key MK1 corresponding to the copying function. In this case, if the usual mode key NK1 is an operating target, the main control portion 110 sets or changes the job executing mode for the copying function to the usual mode (sets the respective feeding speeds of the paper sheet P and document D to the usual speeds). On the other hand, if the quiet-sound mode key SK1 is an operating target, the main control portion 110 sets or changes the job executing mode for the copying function to the quiet-sound mode (sets the feeding speeds for the paper sheet P and document D to speeds slower than the usual speeds). And, the main control portion 110 does not change the job executing modes for the scanning function and the printing function to keep the previous settings.

According to this structure, in a state where all the job executing modes for the plurality of kinds of functions are set to the usual mode, in a case where it is desired to execute a job in the quiet-sound mode only when the predetermined function of the plurality of kinds of functions is used (case where it is desired to execute a job in the usual mode when a function other than the predetermined function is used), by setting the job executing mode for the predetermined function, it becomes unnecessary to change the job executing mode when a function other than the predetermined function is used. In this way, operations (operation for setting or changing the job executing mode) performed by the user decrease; accordingly, the convenience for the user improves. Besides, the mode setting key MK1 is displayed; accordingly, it is possible to make a simple operation (operation of only touching the mode setting key MK1) of the function unit setting operation. Further, the mode setting key MK1 is displayed for each of the plurality of kinds of functions; accordingly, it is easy to understand on which mode setting key MK1 to perform the function unit setting operation.

As to the mode setting key MK1 for the copying function shown in FIG. 5, if the function unit setting operation is performed on the usual mode key NK1, both feeding speeds of the document D and paper sheet P during a time of executing a job of the copying function are set to the usual speeds; if the function unit setting operation is performed on the quiet-sound mode key NK1, both feeding speeds of the document D and paper sheet P during a time of executing a job of the copying function are set to speeds slower than the usual speeds. In other words, it is impossible to set both feeding speeds of the document D and paper sheet P separately from each other during a time of executing a job of the copying function. Because of this, as to a multi-function such as the copying function achieved by two or more functions, the function unit setting operation may be accepted for every two or more functions that compose the multi-function.

Figure 6:
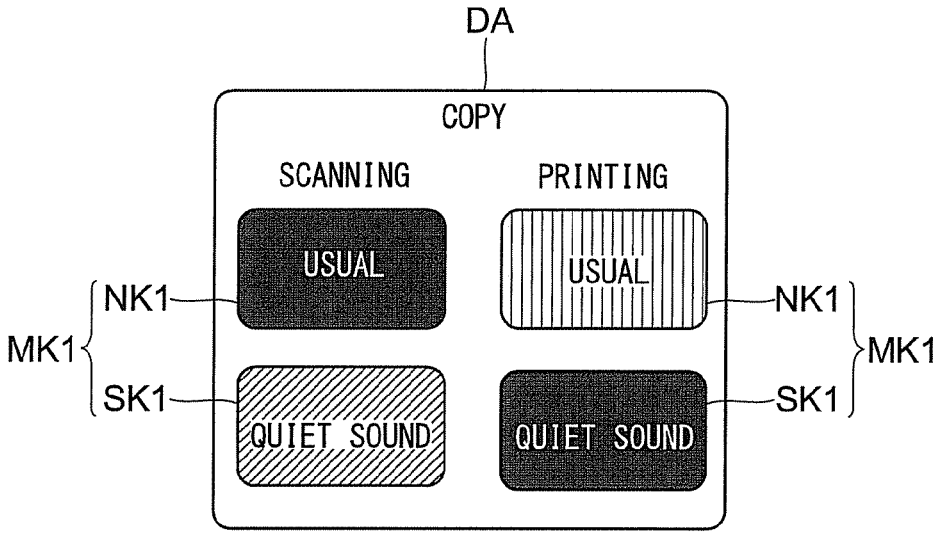
FIG. 6 is a view of a modification of a mode setting key displayed in the screen shown in FIG. 5.

For example, as shown in FIG. 6, the operating panel 109 displays, in the display region DA for the copying function, the two mode setting keys MK1 that correspond to the scanning function and the printing function, respectively. And, as to the copying function, the operating panel 109 accepts the function unit setting operation for each of the two functions of the scanning function and the printing function.

It is assumed that of the mode setting keys MK1 for the copying function shown in FIG. 6, the function unit setting operation is performed on the mode setting key MK1 corresponding to the scanning function. In this case, if the usual mode key NK1 is an operating target, the main control portion 110 sets or changes the feeding speed for the document D during a time of executing a job of the copying function to the usual speed; on the other hand, if the quiet-sound mode key SK1 is an operating target, the main control portion 110 sets or changes the feeding speed of the document D during a time of executing a job of the copying function to a speed slower than the usual speed. At this time, the main control portion 110 does not change the feeding speed of the paper sheet P during a time of executing a job of the copying function to keep the previous setting.

Besides, it is assumed that of the mode setting keys MK1 for the copying function shown in FIG. 6, the function unit setting operation is performed on the mode setting key MK1 corresponding to the printing function. In this case, if the usual mode key NK1 is an operating target, the main control portion 110 sets or changes the feeding speed of the paper sheet P during a time of executing a job of the copying function to the usual speed; on the other hand, if the quiet-sound mode key SK1 is an operating target, the main control portion 110 sets or changes the feeding speed of the paper sheet P during a time of executing a job of the copying function to a speed slower than the usual speed. At this time, the main control portion 110 does not change the feeding speed of the document D during a time of executing a job of the copying function to keep the previous setting.

According to this structure, when using the copying function, it is possible to use the job executing modes different from each other during a scan processing time and a print processing time. Besides, the two mode setting keys MK1 respectively corresponding to the two functions of the scanning function and the printing function that compose the copying function; accordingly, it is possible to easily perform the function unit setting operation for each of the two functions of the scanning function and the printing function that compose the copying function.

When displaying the job executing mode setting screen JS, the operating panel 109 displays, in a visually identifiable manner, whether the job executing mode set for each of the plurality of kinds of functions is the usual mode or the quiet-sound mode. For example, in the case where the job setting mode for the predetermined function is set to the usual mode, the operating panel 109 uses a first display form as a display form of the usual mode key NK1 of the mode setting key MK1 corresponding to the predetermined function and uses a second display form as a display form of the quiet-sound mode key SK1 that is different from the first display form. On the other hand, in the case where the job setting mode for the predetermined function is set to the quiet-sound mode, the operating panel 109 uses the first display form as the display form of the quiet-sound mode key SK1 of the mode setting key MK1 corresponding to the predetermined function and uses the second display form as the display form of the usual mode key NK1.

The first display form is a display form that uses a chromatic color as a display color, while the second display form is a display form that uses an achromatic color as a display color. In FIG. 5 and FIG. 6, for the sake of convenience, of the usual mode keys NK1 and the quiet-sound mode keys SK1, hatching is applied to keys displayed in the first display form that uses a chromatic color as the display color to distinguish the first display form and the second display form from each other. In the meantime, both the display colors when displaying in the first display form and the second display form may be chromatic colors (or achromatic colors), and a hue when displaying in the first display mode may be different from a hue when displaying in the second display form.

Further, the operating panel 109 makes the display form of the usual mode key NK1 when displaying the usual mode key NK1 in the first display mode and the display form of the quiet-sound mode key SK1 when displaying the quiet-sound mode key SK1 in the first display mode different from each other (e.g., makes the display colors or hues different from each other). For example, when displaying the usual mode key NK1 in the first display mode, the operating panel 109 uses a red color as the display color of the usual mode key NK1; when displaying the quiet-sound mode key SK1 in the first display mode, the operating panel 109 uses a blue color as the display color of the quiet-sound mode key SK1 (in FIG. 5 and FIG. 6, difference in the display colors is expressed by hatching directions). According to this structure, by only glancing at the mode setting key MK1, it is possible to recognize the current-time job executing mode for the function corresponding to the mode setting key MK1.

Besides, as shown in FIG. 5, together with the mode setting key MK1, an apparatus image AI of the image forming apparatus 100 is displayed in the job executing mode setting screen JS. When displaying the apparatus image AI, the operating panel 109 uses, as a third display form, a display form of an apparatus portion for achieving a function of the plurality of kinds of functions set to the usual mode while using, as a fourth display form, a display form of an apparatus portion for achieving a function of the plurality of kinds of functions set to the quiet-sound mode that is different from the third display form. For example, the operating panel 109 makes the display color or hue of an apparatus portion displayed in the third display form different from the display color or hue of an apparatus portion displayed in the fourth display form. According to this structure, by only glancing at the apparatus image AI, it is possible to recognize the function set to the usual mode and the function set to the quiet-sound mode.

In the meantime, as to the mode setting key MK1, if the job executing mode for the corresponding function is the usual mode, a red color is used as the display color of the usual mode key NK1, and if the job executing mode for the corresponding function is the quiet-sound mode, a blue color is used as the display color of the quiet-sound mode key SK1 Accordingly, also as to the apparatus image AI, it is preferable that in accordance with the display form of the mode setting key MK1, a red color is used as the display color of the apparatus portion for achieving the function set to the usual mode and a blue color is used as the display color of the apparatus portion for achieving the function set to the quiet-sound mode.

In the meantime, for example, in a case where the scanning function is set to the usual mode and also the copying function (multi-function obtained by combining the scanning function and the printing function with each other) is set to the usual mode, the third display form may be used as the display form of an entirety of the apparatus image AI. However, in the state where the scanning function is set to the usual mode, there is a case where the copying function is set to the quiet-sound mode. In this case, it is impossible to express by means of only one apparatus image AI that the scanning function is set to the usual mode and the copying function is set to the quiet-sound mode.

Accordingly, if any one of the plurality of display regions DA, each of which corresponds to each of the plurality of kinds of functions, is touched, the display of the apparatus image AI may be switched such that the job executing mode for the function corresponding to the touched display region DA becomes identifiable in a visual manner. For example, it is assumed that the display region for the scanning function is touched and the job executing mode of the scanning job is the usual mode. In this case, the operating panel 109 displays the apparatus image AI in which the display color of an apparatus portion for achieving the scanning function is a red color (third display form). The state at this time is a state shown in FIG. 5.

And, in the state shown in FIG. 5, it is assumed that the function unit setting operation is performed on the mode setting key MK1 for the scanning function and the job executing mode for the scanning function is set to the quiet-sound mode. At this time, as shown in FIG. 7, the operating panel 109 displays the apparatus image AI in which a blue color (fourth display form) is used as the display color of the apparatus portion for achieving the scanning function.

Figure 7:
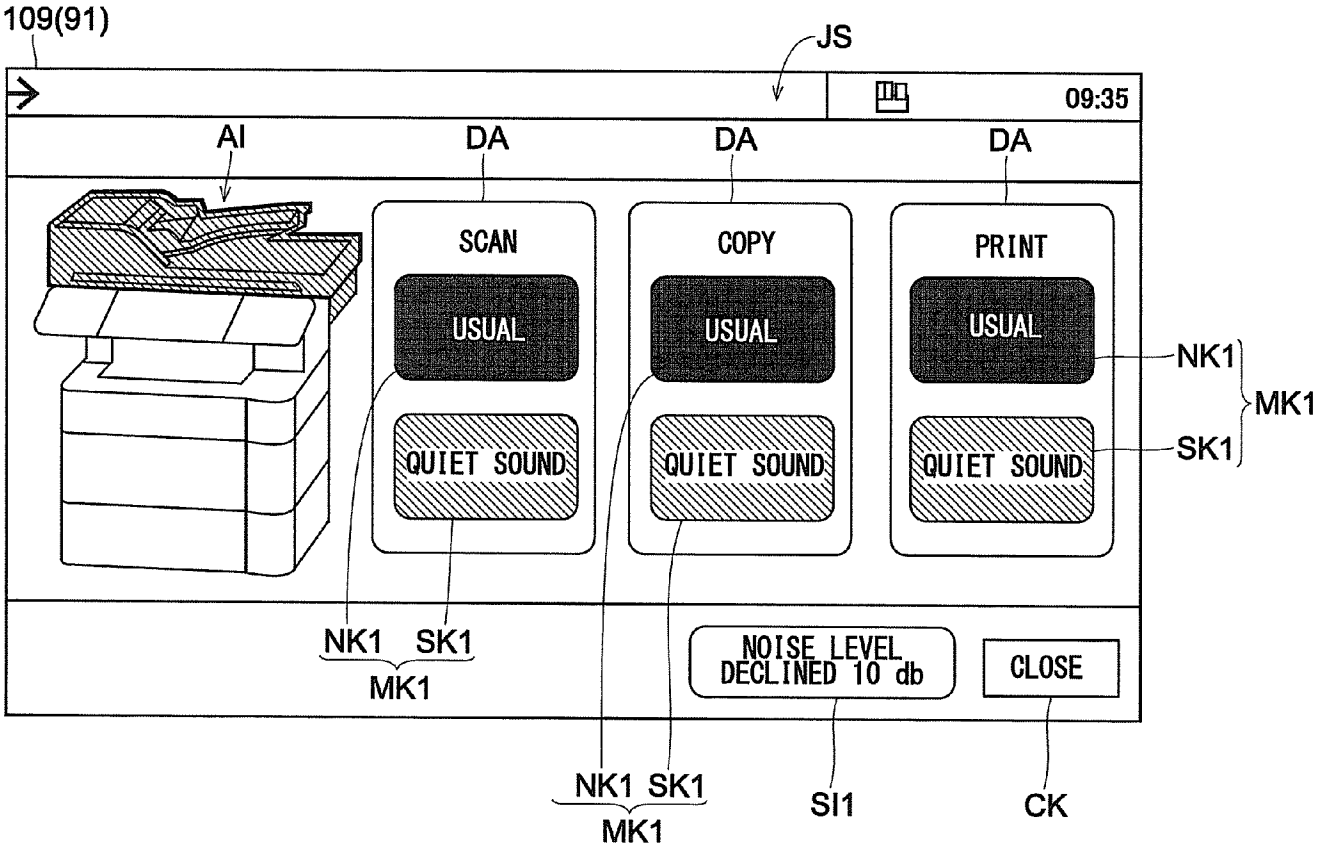
FIG. 7 is a view of a screen (screen for acceptance of setting and changing a job executing mode in a function unit) displayed on the operating panel of the image forming apparatus shown in FIG. 1.
Figure 8:
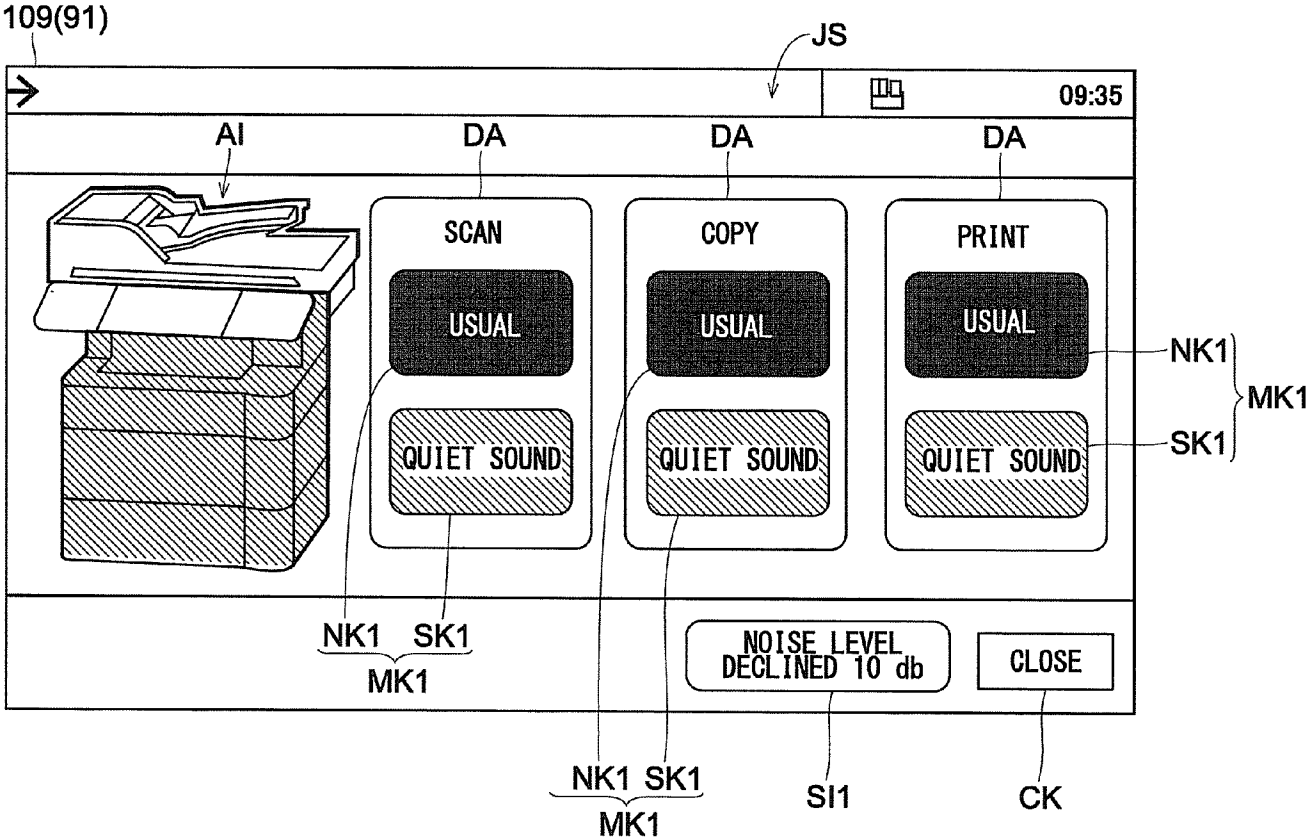
FIG. 8 is a view of a screen (screen for acceptance of setting and changing a job executing mode in a function unit) displayed on the operating panel of the image forming apparatus shown in FIG. 1.

Thereafter, it is assumed that the display region DA for the printing function is touched in the state shown in FIG. 7. The job executing mode for the printing function at this time is the quiet-sound mode. Accordingly, as shown in FIG. 8, the operating panel 109 displays the apparatus image AI in which a blue color is used as the display color of an apparatus portion for achieving the printing function (fourth display form).

Besides, although not shown, if the display region DA for the copying function is touched, the operating panel 109 displays the apparatus image AI in which the display color of the apparatus portion for achieving the copying function is used as the display color that indicates the current-time job executing mode of the copying function, and if the display region DA for the printing function is touched, the operating panel 109 displays the apparatus image AI in which the display color of the apparatus portion for achieving the printing function is used as the display color that indicates the current-time job executing mode for the printing function.

Or, although not shown, the three apparatus images AI may be displayed at the same time: the apparatus image AI in which the display color of the apparatus portion for achieving the scanning function is used as the display color of the current-time job executing mode for the scanning function;

the apparatus image AI in which the display color of the apparatus portion for achieving the copying function is used as the display color of the current-time job executing mode for the copying function; and the apparatus image AI in which the display color of the apparatus portion for achieving the printing function is used as the display color of the current-time job executing mode for the printing function.

Besides, also the operating panel 109 accepts an operation of touching the display region of the apparatus image AI as a function unit setting operation. For example, if a function unit setting operation is performed on a display region for an apparatus portion for achieving any function of the plurality of kinds of functions, the operating panel 109 accepts the job executing mode for the function, which is achieved by the apparatus portion corresponding to the display region on which the function unit setting operation is performed, as a setting or changing target. And, the main control portion 110 sets the job executing mode for the function achieved by the apparatus portion corresponding to the display region on which the function unit setting operation is performed. For example, if the function unit setting operation is performed on the display region for the apparatus portion for achieving the scanning function in the state where the job executing mode for the scanning function is set to the usual mode, the job executing mode for the scanning function is changed to the quiet-sound mode. And, the display color of the apparatus portion for achieving the scanning function is changed from the red color (third display form) to the blue color (fourth display form). According to this structure, by only touching a portion of the apparatus image AI corresponding to a function whose job executing mode is desired to be set or changed, it becomes simple and easy to understand the function unit setting operation.

Besides, the operating panel 109 displays an icon MI1 (see FIG. 4 and FIG. 9) that indicates, in a visually recognizable manner, whether the job executing mode for the plurality of kinds of functions is the usual mode or the quiet-sound mode. For example, the operating panel 109 displays the icon MI1 in a display region for a job executing mode JK.

Figure 9:
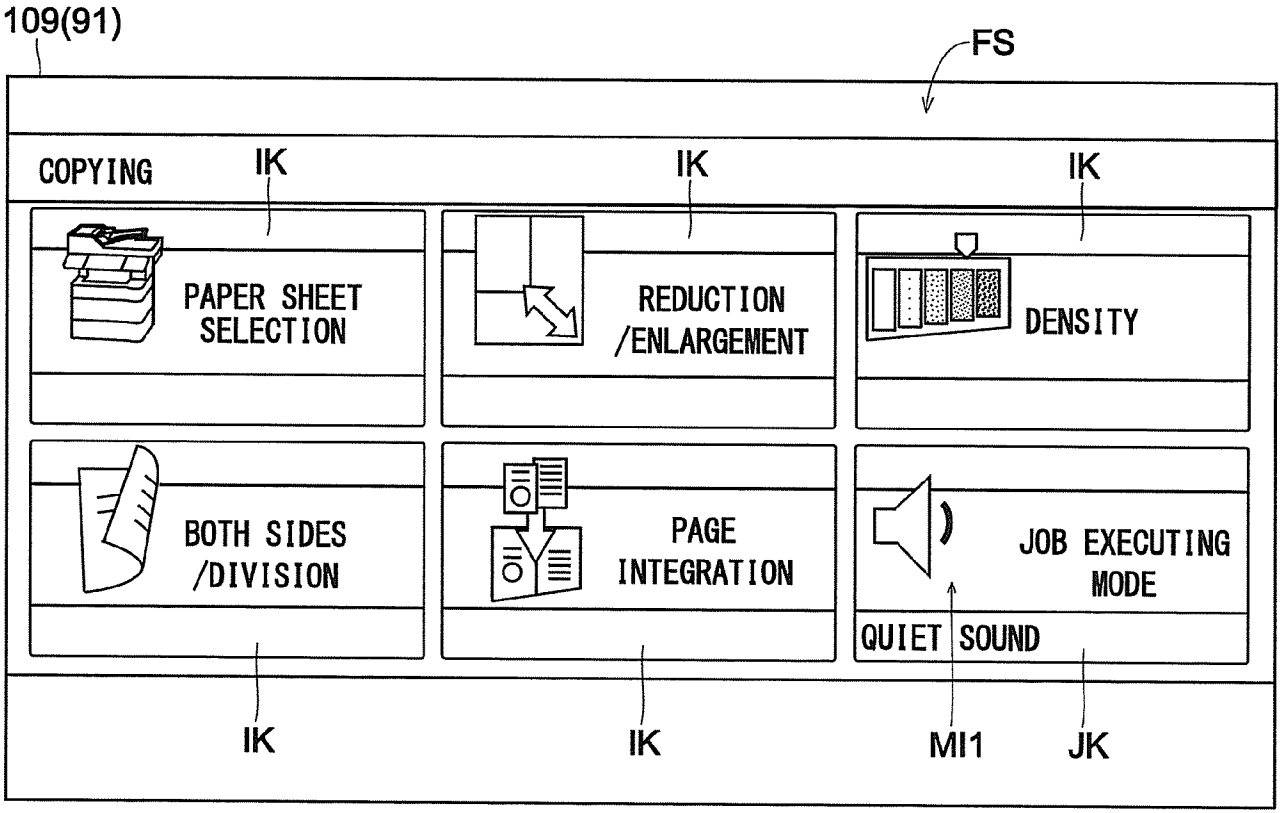
FIG. 9 is a view of a screen displayed on the operating panel of the image forming apparatus shown in FIG. 1.

The icon MI1 changes the display in accordance with whether the job executing mode is set to the usual mode or the quiet-sound mode (sound level released during a time of executing a job). And, in the case where the job executing mode is set to the usual mode, as shown in FIG. 4, the MI1 indicating a large sound level is displayed, and in the case where the job executing mode is set to the quiet-sound mode, as shown in FIG. 9, the MI1 indicating a low sound level is displayed. According to this structure, it becomes easy to identify whether the job executing mode set by the main control portion 110 is the usual mode or the quiet-sound mode.

Besides, if the job executing mode for any function of the plurality of kinds of functions is set or changed, the operating panel 109 displays sound information SI1 that indicates how much the sound level released during a time of executing a job changes in accordance with the setting or changing of the job executing mode. For example, as shown in FIG. 5 and FIG. 7, the operating panel 109 displays, in the job executing mode setting screen JS, a text that indicates a change in the sound level in a decibel unit. In this way, the convenience for the user improves.

Figure 10:
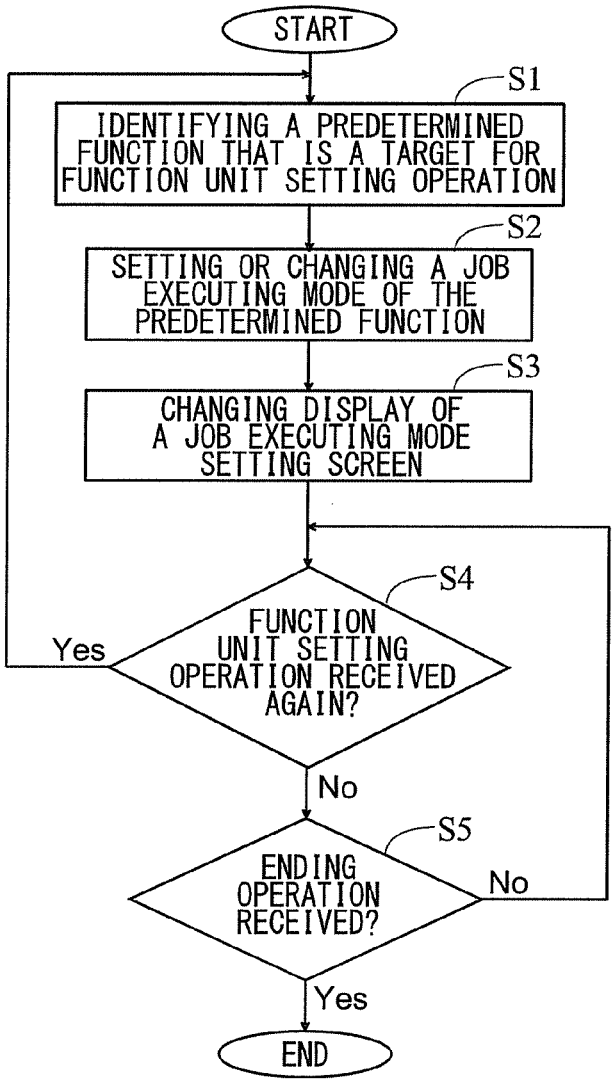
FIG. 10 is a flow chart for describing a flow for setting a job executing mode in a function unit in the image forming apparatus shown in FIG. 1.

Next, with reference to a flow chart shown in FIG. 10, a flow for setting the job executing modes for the plurality of kinds of functions in the function unit is described.

At a start time of the flow chart of FIG. 10, it is assumed that the operating panel 109 displays the job executing mode setting screen JS. In this state, when the panel control portion 150 detects that the function unit setting operation is performed on the operating panel 109, the flow chart of FIG. 10 starts.

In a step S1, based on a detection result from the panel control portion 150, the main control portion 110 identifies a predetermined function of the plurality of kinds of functions that is a target for the function unit setting operation.

In a step S2, the main control portion 110 sets the job executing mode for the predetermined function. At this time, the main control portion 110 does not change the job executing mode for a function other than the predetermined function to keep the previous setting.

In a step S3, the main control portion 110 instructs the panel control portion 150 to change the display of the job executing mode setting screen JS. Specifically, in the case where the job executing mode for the predetermined function is set to the usual mode, the panel control portion 150 uses the first display form as the display form of the usual mode key NK1 of the mode setting key MK1 that corresponds to the predetermined function (e.g., a red color is used as the display color), and uses the second display form as the display form of the quiet-sound mode key SK1 (e.g., a gray color is used as the display color). On the other hand, in the case where the job executing mode for the predetermined function is set to the quiet-sound mode, the panel control portion 150 uses the first display form as the display form of the quiet-sound mode key SK1 of the mode setting key MK1 that corresponds to the predetermined function (e.g., a blue color is used as the display color), and uses the second display form as the display form of the usual mode key NK1 (e.g., a gray color is used as the display color).

Further, in the case where the job executing mode for the predetermined function is set to the usual mode, the panel control portion 150 uses the third display form as the display form of an apparatus portion of the apparatus image AI for achieving the predetermined function (e.g., a red color is used as the display color). On the other hand, in the case where the job executing mode for the predetermined function is set to the quiet-sound mode, the panel control portion 150 uses the fourth display form as the display form of the apparatus portion of the apparatus image AI for achieving the predetermined function (e.g., a blue color is used as the display color).

In a step S4, the main control portion 110 determines whether the operating panel 109 accepts again the function unit setting operation or not. As a result of this, if it is found out that the operating panel 109 accepts the function unit setting operation, the main control portion 110 goes to the step S1. On the other hand, if it is found out that the operating panel 109 does not accept the function unit setting operation, the main control portion 110 goes to a step S5.

Going to the step S5, the main control portion 110 determines whether the operating panel 109 accepts an ending operation for closing the job executing mode setting screen JS or not. In the meantime, for example, the operating panel 109 accepts, as an ending operation, an operation of touching a key CK of "close" (see FIG. 5 and FIG. 7) displayed in the job executing mode setting screen JS. As a result of this, if it is found out that the operating panel 109 accepts the ending operation, the flow chart of FIG. 10 ends. On the other hand, if it is found out that the operating panel 109 does not accept the ending operation, the main control portion 110 goes to the step S4.

In the meantime, in the case where the plurality of stages of paper sheet supplying portions 104 are disposed in the image forming apparatus 100, as to functions (copying function and printing function) that use the paper sheet supplying portion 104, a cassette unit setting operation for setting the job executing mode in a unit of the paper sheet supplying portion 104 (unit of the paper sheet supplying cassette 41) may be accepted. For example, when a display region for a portion of the apparatus image AI corresponding to the paper sheet supplying portion 104 is touched, the operating panel 109 accepts the touch operation as the cassette unit setting operation.

If the cassette unit setting operation is performed on a display region for a portion corresponding to the top-stage paper sheet supplying portion 104, the main control portion 110 sets or changes the job executing mode for a function that uses the top-stage paper sheet supplying portion 104, and does not change the job executing mode for a function that uses the bottom-stage paper sheet supplying portion 104 to keep the previous setting. Besides, if the cassette unit setting operation is performed on a display region for a portion corresponding to the bottom-stage paper sheet supplying portion 104, the main control portion 110 sets or changes the job executing mode for a function that uses the bottom-stage paper sheet supplying portion 104, and does not change the job executing mode for a function that uses the top-stage paper sheet supplying portion 104 to keep the previous setting. According to this structure, in the case where the paper sheet supplying portion 104 is disposed in the plurality of stages in the image forming apparatus 100, it is possible to set or change the job executing mode in the unit of the paper sheet supplying portion 104.

In the meantime, the screen, which accepts the function unit setting operation for setting the job executing modes for the plurality of kinds of functions in the function unit, is not limited to the job executing mode setting screen JS shown in FIG. 5 and FIG. 7.

Figure 11:
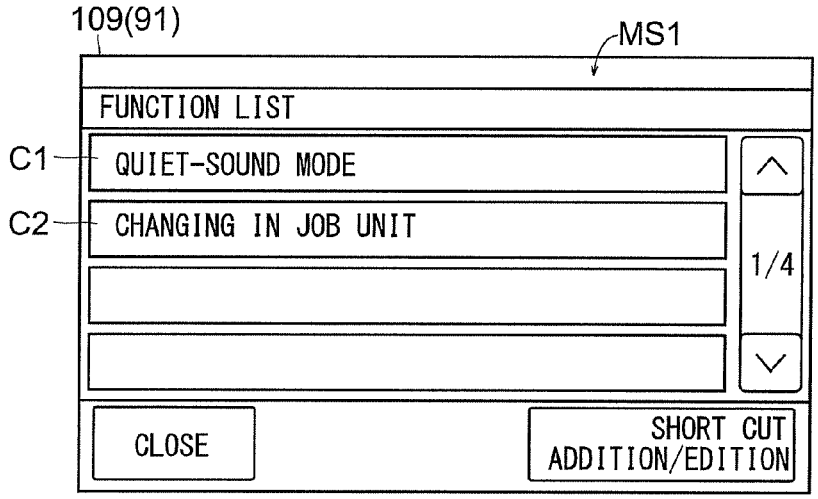
FIG. 11 is a view of a screen (screen for acceptance of setting and changing a job executing mode) displayed on the operating panel of the image forming apparatus shown in FIG. 1.
Figure 12:
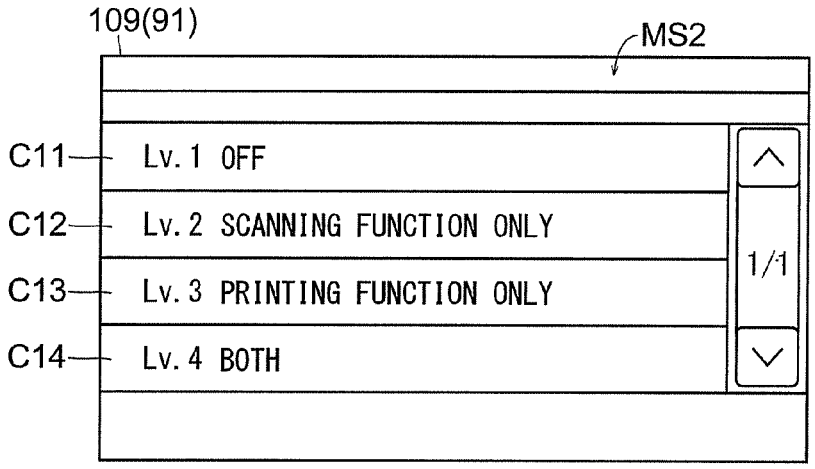
FIG. 12 is a view of a screen (screen for acceptance of setting and changing a job executing mode) displayed on the operating panel of the image forming apparatus shown in FIG. 1.

For example, the operating panel 109 displays a menu screen MS1 as shown in FIG. 11. Then, if a menu box C1 representing "quiet-sound mode" in the menu screen MS1 is touched, the operating panel 109 displays a menu screen MS2 as shown in FIG. 12. The menu screen MS2 displays: a menu box C11 representing "OFF"; a menu box C12 representing "scanning function only"; a menu box C13 representing "printing function only"; and a menu box C14 representing "both." And, if the menu box C12 or C13 of the menu boxes C11 to C14 in the menu screen MS2 is touched, the operating panel 109 accepts the touch operation as the function unit setting operation.

If the function unit setting operation is performed on the menu box C12, the main control portion 110 sets the job executing mode for the scanning function to the quiet-sound mode. Besides, if the function unit setting operation is performed on the menu box C13, the main control portion 110 sets the job executing mode for the printing function to the quiet-sound mode. In the meantime, in the menu screen MS2, the scanning function also includes a scanning function that composes the copying function which is a multi-function, while also the printing function includes a printing function that composes the copying function that is the multi-function.

Besides, in the menu screen MS2, the operating panel 109 accepts a concurrent changing operation for concurrently changing all the job executing modes for the plurality of kinds of functions to the same job executing mode. Specifically, if the menu box C11 or C14 of the menu boxes C11 to C14 in the menu screen MS2 is touched, the operating panel 109 accepts the touch operation as the concurrent changing operation. If the concurrent changing operation is performed on the menu box C11, the main control portion 110 sets all the job executing modes for the plurality of kinds of functions to the usual mode, and if the concurrent changing operation is performed on the menu box C14, the main control portion 110 sets all the job executing modes for the plurality of kinds of functions to the quiet-sound mode. According to this structure, it is possible to set the job executing modes for the plurality of kinds of functions in the function unit, and it is also possible to change all the job executing modes for the plurality of kinds of functions to the same job executing mode; accordingly, the convenience for the user improves.

Figure 13:
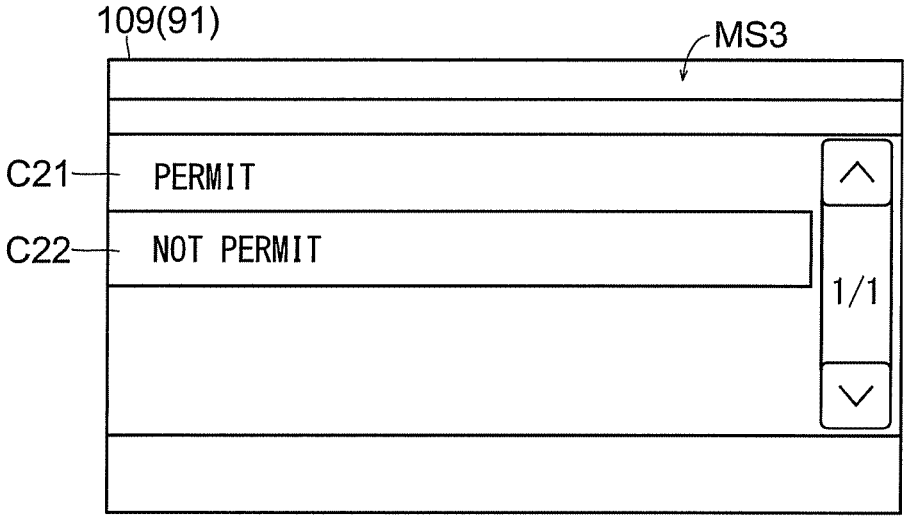
FIG. 13 is a view of a screen (screen for acceptance of permission or non-permission to set and change a job executing mode) displayed on the operating panel of the image forming apparatus shown in FIG. 1.

In the meantime, if a menu box C2 representing "change in job unit" in the menu screen MS1 is touched, the operating panel 109 displays a menu screen MS3 as shown in FIG. 13. The menu screen MS3 displays a menu box C21 representing "permit" and a menu box C22 representing "not permit."

And, by touching the menu box C21, it becomes possible to set or change the job executing mode of an executing target job in an executing target job unit, and by touching the menu box C22, it becomes impossible to set or change the job executing mode of the executing target job in the executing target job unit. In the meantime, the setting and changing of the job executing mode of the executing target job in the executing target job unit is described in detail later.

For example, the image forming apparatus 100 may incorporate a user authenticating function, and authorization for operating on the screens shown in FIG. 11 to FIG. 13 may be given to an supervisor only who supervises the image forming apparatus 100. In the meantime, the user authenticating function is described in detail later.

(Setting of Job Executing Mode of Executing Target Job in Executing Target Job Unit)

The operating panel 109 accepts a job unit setting operation for setting the job executing mode of an executing target job (at least one job of a job under execution and a standby job) in an executing target job unit. The acceptance of the job unit setting operation by the operating panel 109 is performed during at least one period of a job executing period during which the executing target job is executed and a job standby period during which the executing target job is on standby.

First, a case where the executing target job is a printing job (also inclusive of a printing process of a copying job) is described.

Figure 14:
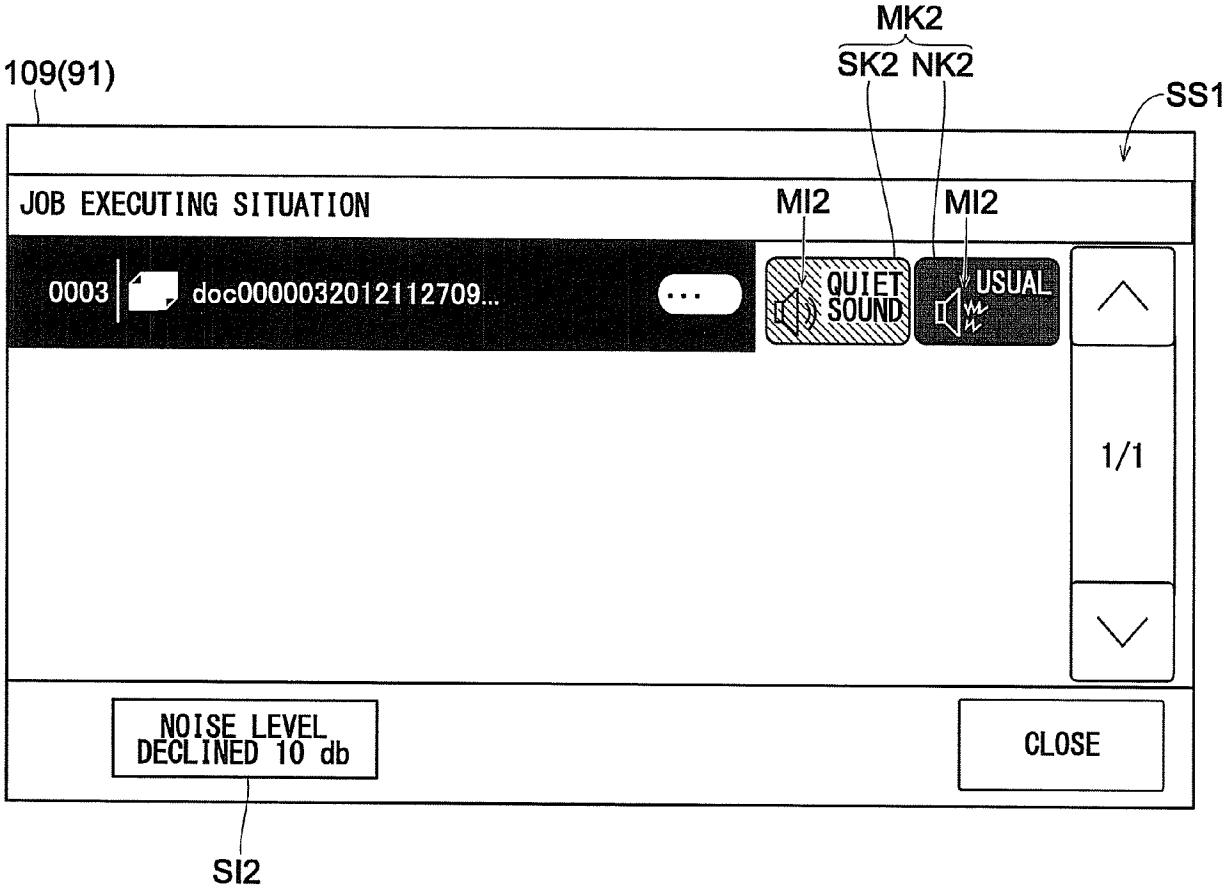
FIG. 14 is a view of a screen (screen for acceptance of setting and changing a job executing mode in an executing target job unit) displayed on the operating panel of the image forming apparatus shown in FIG. 1.

In the case where the executing target job is a printing job, if a situation confirming key 95 (see FIG. 2) is pushed down during at least one period of the job executing period and the job standby period, the operating panel 109 displays a job executing situation screen SS1 as shown in FIG. 14. The job executing situation screen SS1 displays job information (e.g., file format, data name and the like) of the executing target job. In this job executing situation screen SS1, to distinguish whether the executing target job is a job under execution or a standby job, the display color of the job information of a job under execution is reversed (whitened). As an example, FIG. 14 shows the job executing situation screen SS1 in the case where the executing target job is a job under execution.

Also, the job executing situation screen SS1 displays a mode setting key MK2 that has a usual mode key NK2 and a quiet-sound mode key SK2. The mode setting key MK2 is a key for accepting the setting and changing of the job executing mode of the executing target job that corresponds to the job information displayed in the job executing situation screen SS1. Besides, the usual mode key NK2 is a key for setting or changing the job executing mode to the usual mode, while the quiet-sound mode key SK2 is a key for setting or changing the job executing mode to the quiet-sound mode.

If the mode setting key MK2 is touched, the operating panel 109 accepts the touch operation as the job unit setting operation. And, when the operating panel 109 accepts the function unit setting operation, the main control portion 110 changes the job executing mode of the executing target job in the executing target job unit based on the job unit setting operation accepted by the operating panel 109.

Specifically, when the job unit setting operation is performed on the mode setting key MK2, if the usual mode key NK2 is an operating target, the main control portion 110 sets or changes the job executing mode to the usual mode. On the other hand, when the job unit setting operation is performed on the mode setting key MK2, if the quiet-sound mode key SK2 is an operating target, the main control portion 110 sets or changes the job executing mode to the quiet-sound mode.

At this time, if the executing target job is a job under execution, after the paper sheets P under feed are all ejected, the main control portion 110 stops the executing target job temporarily. And, after setting or changing the job executing mode of the executing target job, the main control portion 110 resumes the executing target job at a processing speed that corresponds to the set or changed job executing mode. Besides, if the executing target job is a standby job, after setting or changing the job executing mode of the executing target job, the main control portion 110 starts the executing target job at a processing speed that corresponds to the set or changed job executing mode.

According to this structure, it is possible to set or change the job executing mode of the executing target job under execution during the execution of the executing target job, and it is also possible to set or change the job executing mode of the executing target job on standby during the standby of the executing target job. Besides, it is possible to set or change the job executing mode of the executing target job in the executing target job unit; accordingly, in a case where a plurality of executing target jobs are on standby, it is also possible to set or change the job executing mode only of a specific executing target job of the plurality of executing target jobs and keep the previous setting of the job executing modes of the remaining executing target jobs. Further, in a case where another executing target job is on standby during the execution of the executing target job, it is also possible to set or change the job executing mode only of the executing target job under execution, or set or change the job executing mode only of the executing target job on standby. In this way, the convenience for the user improves. Besides, the mode setting key MK2 is displayed; accordingly, it is possible to make a simple operation (operation of only touching the mode setting key MK2) of the job unit setting operation. Further, the mode setting key MK2 is displayed in the job executing situation screen SS1; accordingly, it is possible to determine, confirming the executing situation of the executing target job, whether or not the job executing mode should be set or changed.

Figure 15:
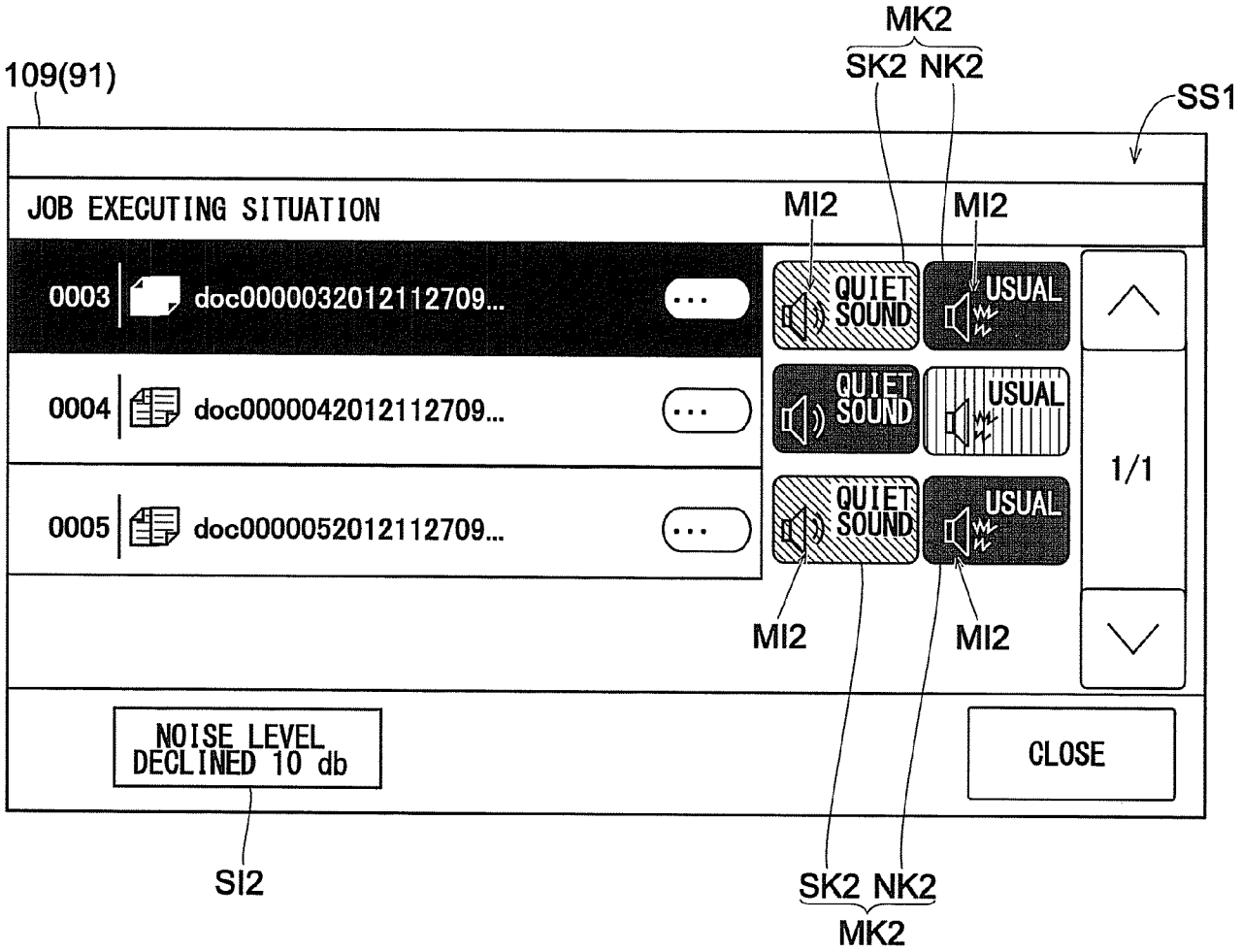
FIG. 15 is a view of a screen (screen for acceptance of setting and changing a job executing mode in an executing target job unit) displayed on the operating panel of the image forming apparatus shown in FIG. 1.

Up to now, the case where there is one executing target job is described; however, the number of executing target jobs is not always one, but there is a case where a plurality of executing target jobs exist. For example, there is a case where another executing target job is on standby during a time of executing a predetermined executing target job. In such a case, it is impossible to set or change the job executing modes of the plurality of executing target jobs in the executing target job unit by means of only one mode setting key MK2 displayed in the job executing situation screen SS1. Accordingly, as shown in FIG. 15, the operating panel 109 displays a plurality of mode setting keys MK2 each of which corresponds to each of the plurality of executing target jobs. For example, the operating panel 109 displays one mode setting key MK2 in each of a plurality of representing boxes each of which represents the job information of each of the plurality of executing target jobs.

And, when the job unit setting operation is performed on the mode setting key MK2, if the usual mode key NK2 is an operating target, the main control portion 110 sets or changes the job executing mode of a predetermined executing target job, which corresponds to the mode setting key MK2 on which the job unit setting operation is performed, to the usual mode. On the other hand, when the job unit setting operation is performed on the mode setting key MK2, if the quiet-sound mode key SK2 is an operating target, the main control portion 110 sets or changes the job executing mode of a predetermined executing target job, which corresponds to the mode setting key MK2 on which the job unit setting operation is performed, to the quiet-sound mode. At this time, the main control portion 110 does not change the job executing mode of an executing target job other than the predetermined executing target job to keep the previous setting. According to this structure, even in the case where a plurality of executing target jobs exist, it is possible to set or change the job executing modes of the plurality of executing target jobs in the executing target job unit.

Next, a case where the executing target job is a scanning job (also inclusive of a scanning process of a copying job) is described.

Figure 16:
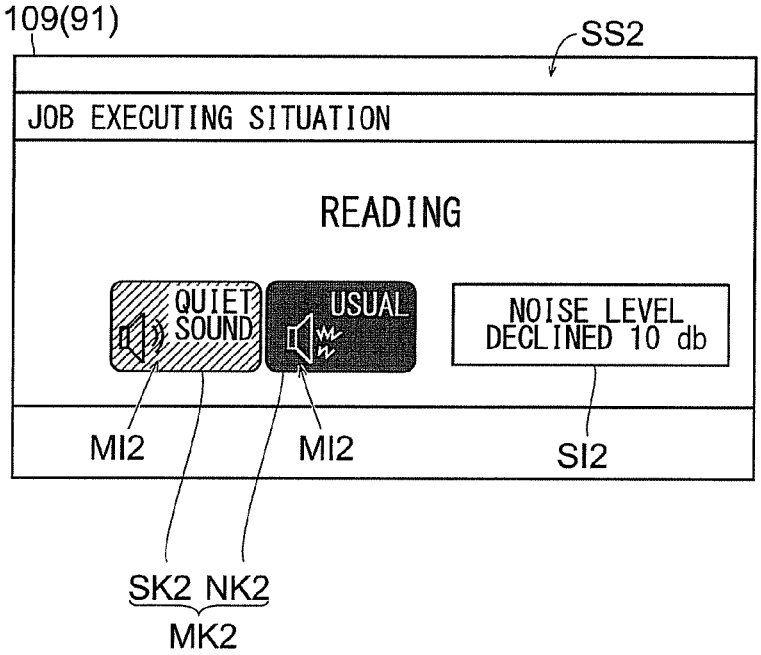
FIG. 16 is a view of a screen (screen for acceptance of setting and changing a job executing mode in an executing target job unit) displayed on the operating panel of the image forming apparatus shown in FIG. 1.

In a case where the executing target job is a scanning job, as shown in FIG. 16, the operating panel 109 displays a job executing situation screen SS2 during a job executing time. The job executing situation screen SS2 displays, for example, a message indicating that a scanning job is under execution. And, also the operating panel 109 displays the mode setting key MK2 in the job executing situation screen SS2, and accepts an operation of touching the mode setting key MK2 as the job unit setting operation. And, when the operating panel 109 accepts the job setting operation, based on the job unit setting operation accepted by the operating panel 109, the main control portion 110 sets or changes the job executing mode of the executing target job in the executing target job unit.

In the meantime, also in the case where the executing target job is a scanning job, it is possible to obtain the same effects as in the case where the executing target job is a printing job.

In the meantime, when displaying the job executing situation screens SS1 and SS2, the operating panel 109 indicates, in a visually identifiable manner, whether the job executing mode of the executing target job is the usual mode or the quiet-sound mode. For example, in the case where the job executing mode of the executing target job is the usual mode, the operating panel 109 uses the first display form as the display form of the usual mode key NK2 of the mode setting key MK2 (e.g., a chromatic color is used as the display color), and uses the second display form as the display form of the quiet-sound mode key SK2 (e.g., an achromatic color is used as the display color) that is different from the first display form. On the other hand, in the case where the job executing mode of the executing target job is the quiet-sound mode, the operating panel 109 uses the first display form as the display form of the quiet-sound mode key SK2 of the mode setting key MK2, and uses the second display form as the display form of the usual mode key NK2. For the sake of convenience, in FIG. 14 to FIG. 16, the first display form and the second display form are distinguished from each other by hatching keys of the usual mode key NK2 and quiet-sound mode key SK2 that are displayed in the first display form.

Further, the operating panel 109 makes the display form of the usual mode key NK2 when displaying the usual mode key NK2 in the first display mode and the display form of the quiet-sound mode key SK2 when displaying the quiet-sound mode key SK2 in the first display mode different from each other (e.g., makes the display colors or hues different from each other). According to this structure, by only glancing at the mode setting key MK2, it is possible to recognize the current-time job executing mode of the executing target job corresponding to the mode setting key MK2.

In the meantime, as to the mode setting key MK1 shown in FIG. 5 to FIG. 7, if the job executing mode for the corresponding function is the usual mode, the red color is used as the display color of the usual mode key NK1, and if the job executing mode for the corresponding function is the quiet-sound mode, the blue color is used as the display color of the quiet-sound mode key SK1. Accordingly, also as to the mode setting key MK2, it is preferable that in accordance with the display form of the mode setting key MK1, a red color is used as the display color of the usual mode key NK2 if the job executing mode of the executing target job is the usual mode; and a blue color is used as the display color of the quiet-sound mode key SK2 if the job executing mode of the executing target job is the quiet-sound mode.

Besides, the operating panel 109 displays an icon MI2 (see FIG. 14 to FIG. 16) that indicates, in a visually recognizable manner, whether the job executing mode set by the main control portion 110 is the usual mode or the quiet-sound mode. For example, the operating panel 109 displays the icon MI2 in a display region for the mode setting key MK2. According to this structure, it becomes easy to identify whether the job executing mode set by the main control portion 110 is the usual mode or the quiet-sound mode.

Besides, the operating panel 109 displays sound information SI2 that indicates how much the sound level released during a time of executing a job changes in accordance with the setting or changing of the job executing mode. For example, as shown in FIG. 14 to FIG. 16, the operating panel 109 displays, in the job executing situation screen 881 (SS2), a text that indicates a change in the sound level in a decibel unit. In this way, the convenience for the user improves.

Figure 17:
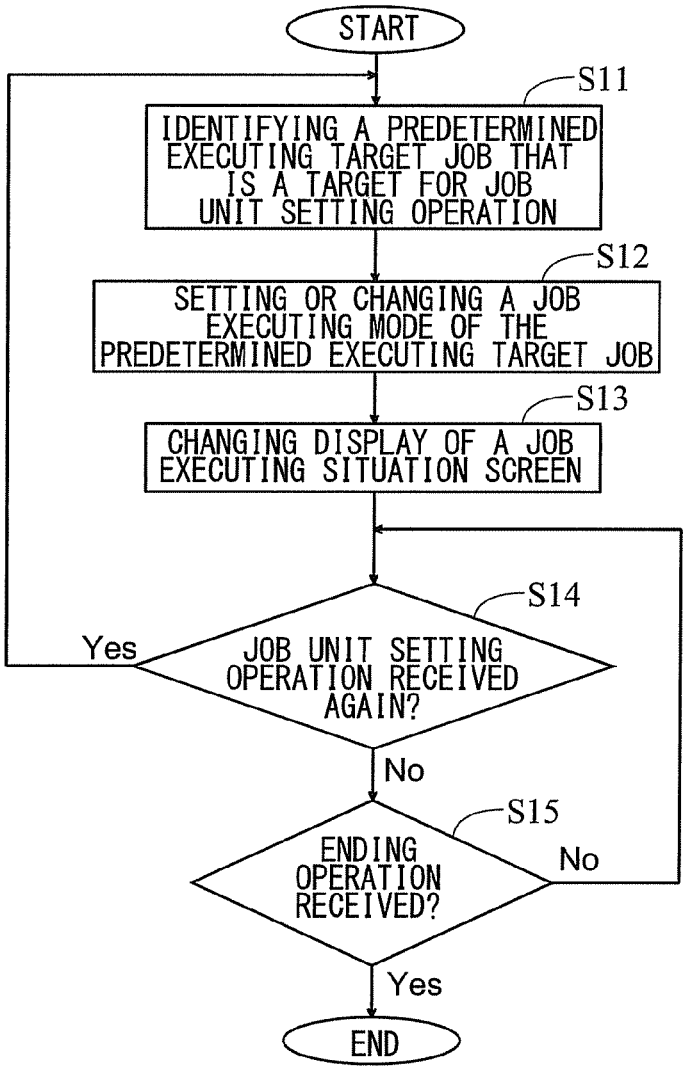
FIG. 17 is a flow chart for describing a flow for setting a job executing mode in an executing target job unit in the image forming apparatus shown in FIG. 1.

Next, with reference to a flow chart shown in FIG. 17, a flow for setting the job executing mode of the executing target job in the executing target job unit is described.

At a start time of the flow chart of FIG. 17, it is assumed that the operating panel 109 displays the job executing situation screen 881 (SS2). In this state, when the panel control portion 150 detects that the job unit setting operation is performed on the operating panel 109, the flow chart of FIG. 17 starts.

In a step S11, based on a detection result received from the panel control portion 150, the main control portion 110 identifies a predetermined executing target job that is a target for the job unit setting operation.

In a step S12, the main control portion 110 sets or changes the job executing mode of the predetermined executing target job. At this time, in a case where the predetermined executing target job is a job under execution, the main control portion 110 stops the predetermined executing target job temporarily, after setting or changing the job executing mode of the predetermined executing target job, the main control portion 110 resumes the predetermined executing target job at a processing speed that corresponds to the set or changed job executing mode. Besides, in a case where a plurality of executing target jobs including the predetermined executing target job exist, the main control portion 110 sets or changes the job executing mode only of the predetermined executing target job, and does not set or change the job executing mode of an executing target job other than the predetermined executing target job to keep the previous setting.

In a step S13, the main control portion 110 instructs the panel control portion 150 to change the display of the job executing situation screen SS1 (SS2). Specifically, in the case where the job executing mode of the predetermined executing target job is set to the usual mode, the panel control portion 150 uses the first display form as the display form of the usual mode key NK2 of the mode setting key MK2 that corresponds to the predetermined executing target job, and uses the second display form as the display form of the quiet-sound mode key SK2. On the other hand, in the case where the job executing mode of the predetermined executing target job is set to the quiet-sound mode, the panel control portion 150 uses the first display form as the display form of the quiet-sound mode key SK2 of the mode setting key MK2 that corresponds to the predetermined executing target job, and uses the second display form as the display form of the usual mode key NK2.

In a step S14, the main control portion 110 determines whether the operating panel 109 accepts again the job unit setting operation or not. As a result of this, if it is found out that the operating panel 109 accepts the job unit setting operation, the main control portion 110 goes to a step S11. On the other hand, if it is found out that the operating panel 109 does not accept the job unit setting operation, the main control portion 110 goes to a step S15.

Going to the step S15, the main control portion 110 determines whether all the executing target jobs are ended or not. As a result of this, if it is found out that all the executing target jobs are ended, the flow chart of FIG. 17 ends. On the other hand, if it is found out that all the executing target jobs are not ended, the main control portion 110 goes to the step S14.

In the meantime, the job executing mode of the executing target job may be set or changed in accordance with a job amount of the executing target job. In this case, the main control portion 110 calculates the job amount based on job data of the executing target job, and determines whether the job amount of the executing target job exceeds a predetermined threshold value or not. And, if the job amount of the executing target job exceeds the threshold value, the main control portion 110 sets the job executing mode of the executing target job to the usual mode, and if the job amount of the executing target job does not exceed the threshold value, the main control portion 110 sets the job executing mode of the executing target job to the quiet-sound mode.

For example, when executing a printing job (also inclusive of a printing process of a copying job), if the job amount of the printing job exceeds the threshold value, the main control portion 110 sets the job executing mode of the printing job to the usual mode, and if the job amount of the printing job does not exceed the threshold value, the main control portion 110 sets the job executing mode of the printing job to the quiet-sound mode. Or, when executing the printing job, if the job amount of a job on standby exceeds the threshold value, the main control portion 110 sets the job executing mode of the printing job to the usual mode, and if the job amount of the job on standby does not exceed the threshold value, the main control portion 110 sets the job executing mode of the printing job to the quiet-sound mode. Besides, if the job amount of the job on standby exceeds the threshold value during the execution of the printing job, the main control portion 110 sets the job executing mode of the job under execution to the usual mode, and if the job amount of the job on standby becomes equal to or smaller than the threshold value during the execution of the printing job, the main control portion 110 sets the job executing mode of the printing job to the quiet-sound mode.

Besides, for example, the main control portion 110 counts the number of read paper sheets (which corresponds to the job amount) during the execution of a scanning job (also inclusive of a scanning process of a copying job). And, when the number read paper sheets exceeds a predetermined threshold value, if the job executing mode of the scanning job under execution is set to the quiet-sound mode, the main control portion 110 changes the job executing mode of the scanning job under execution to the usual mode.

According to this structure, even if the job executing mode is set to the quiet-sound mode, in a case where the job amount is large, the quiet-sound mode is automatically changed to the usual mode; accordingly, it is possible to rapidly end the job. Reversely, even if the job executing mode is set to the usual mode, in a case where the job amount is small (case where the period to the job end is expected to be short), the usual mode is automatically changed to the quiet-sound mode.

(Setting of Job Executing Mode (Default Mode) Associated with Power Mode)

Figure 18:
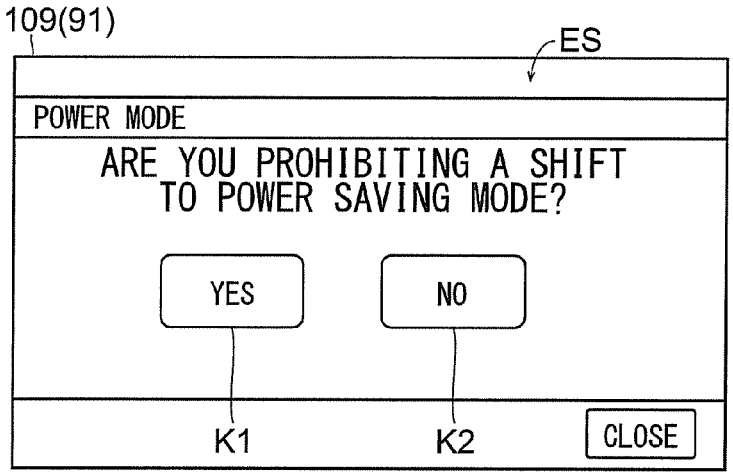
FIG. 18 is a view of a screen (screen for acceptance of setting a power mode) displayed on the operating panel of the image forming apparatus shown in FIG. 1.

The operating panel 109 accepts a power mode setting operation for setting whether to prohibit a shift from the usual power mode to the power saving mode or not. When accepting the power mode setting operation, the operating panel 109 displays a power mode setting screen ES as shown in FIG. 18. If a key K1 of "Yes" is touched, the operating panel 109 accepts information indicating that the shift from the usual power mode to the power saving mode is prohibited. If the operating panel 109 accepts the information indicating that the shift from the usual power mode to the power saving mode is prohibited, the main control portion 110 prohibits the shift from the usual power mode to the power saving mode. On the other hand, if a key K2 of "No" is touched, the operating panel 109 accepts information indicating that the shift from the usual power mode to the power saving mode is permitted. If the operating panel 109 accepts the information indicating that the shift from the usual power mode to the power saving mode is permitted, the main control portion 110 permits the shift from the usual power mode to the power saving mode when a shift condition from the usual power mode to the power saving mode is satisfied.

In this structure, the job executing mode (default mode) of a default stored in the storage portion 112 may be associated with the power mode. Specifically, when the operating panel 109 accepts the information indicating that the shift from the usual power mode to the power saving mode is prohibited, the storage portion 112 stores the usual mode as the default mode. Accordingly, at the startup time of the image forming apparatus 100 after the operating panel 109 accepts information indicating that the shift from the usual power mode to the power saving mode is restricted, the job executing mode is set to the usual mode that is the default mode. In the meantime, the startup time of the image forming apparatus 100 in this case means a time when the main power source of the image forming apparatus 100 is turned on again after the main power source is shut down because the main power source does not shift from the usual power mode to the power saving mode.

On the other hand, when the operating panel 109 accepts the information indicating that the shift from the usual power mode to the power saving mode is permitted, the storage portion 112 stores the quiet-sound mode as the default mode. Accordingly, at the startup time of the image forming apparatus 100 after the operating panel 109 accepts the information indicating that the shift from the usual power mode to the power saving mode is permitted, the job executing mode is set to the quiet-sound mode that is the default mode. In the meantime, the startup time of the image forming apparatus 100 in this case means a time when the main power source of the image forming apparatus 100 is turned on again after the main power source is shut down or a time when the main power source returns from the power saving mode to the usual power mode.

Here, the user prohibiting the shift from the usual power mode to the power saving mode often uses the image forming apparatus 100; accordingly, there are many cases where the user wants to end the job rapidly. Accordingly, if a structure is employed, in which when the operating panel 109 accepts the information indicating that the shift from the usual power mode to the power saving mode is prohibited, the storage portion 112 stores the usual mode as the default mode, the convenience for the user improves.

(Setting of Job Executing Mode (Default Mode) Associated with Job Executing Frequency)

The main control portion 110 compares a job executing frequency in the usual mode with a job executing frequency in the quiet-sound mode during a predetermined period. The predetermined period is not especially limited, but for example, may be a period from a time when the main power source of the image forming apparatus 100 is turned on to a time when the main power source is shut down, or may be one day to dozens of days.

In this structure, the job executing mode (default mode) of the default stored in the storage portion 112 may be associated with the job executing frequency. Specifically, if the job executing frequency in the usual mode is higher than the job executing frequency in the quiet-sound mode during the predetermined period, the storage portion 112 stores the usual mode as the default mode. In this way, in the case where the job executing frequency in the usual mode is higher than the job executing frequency in the quiet-sound mode during the predetermined period, at the startup time of the image forming apparatus 100 after a time when the predetermined period ends, the job executing mode is set to the usual mode that is the default mode.

On the other hand, if the job executing frequency in the quiet-sound mode is higher than the job executing frequency in the usual mode during the predetermined period, the storage portion 112 stores the quiet-sound mode as the default mode. In this way, in the case where the job executing frequency in the quiet-sound mode is higher than the job executing frequency in the usual mode during the predetermined period, at the startup time of the image forming apparatus 100 after a time when the predetermined period ends, the job executing mode is set to the quiet-sound mode that is the default mode.

According to this structure, the job executing mode set at the startup time of the image forming apparatus 100 becomes the job executing mode in accordance with a use situation of the image forming apparatus 100; accordingly, the convenience for the user improves.

(Setting of Job Executing Mode (Default Mode) Associated with User Authentication)

The image forming apparatus 100 incorporates a user authenticating function (log-in function). In this image forming apparatus 100, authentication information for authenticating the user is registered beforehand, and stored in the storage portion 112.

Figure 19:
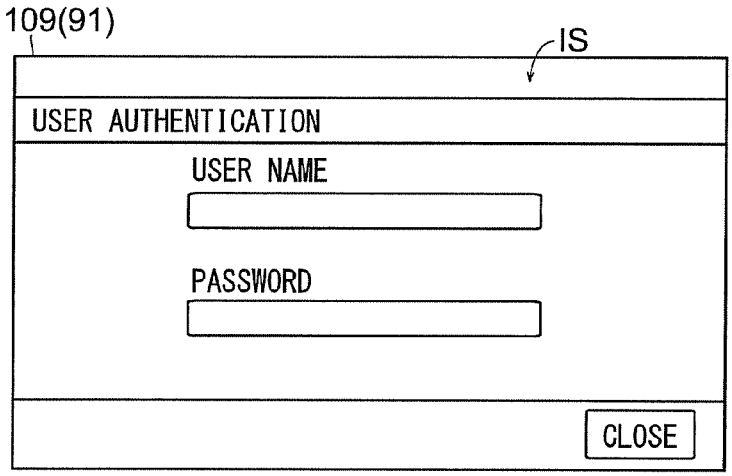
FIG. 19 is a view of a screen (screen for acceptance of user authentication) displayed on the operating panel of the image forming apparatus shown in FIG. 1.

The user to be authenticated inputs first the user's own identification information (e.g., user name, password). The operating panel 109 accepts the input of the identification information from the user. When accepting the identification information from the user, the operating panel 109 displays an identification information inputting screen IS as shown in FIG. 19. And, based on the identification information and authentication information input by the user, the main control portion 110 determines whether to authenticate the user who inputs the identification information or not. For example, if the identification information and the authentication information input by the user match with each other, the main control portion 110 authenticates the user who inputs the identification information (permits a log-in to the image forming apparatus 100).

Here, the storage portion 112 relates either one of the usual mode and the quiet-sound mode to the authentication information and stores it as the default mode. In the meantime, the user can decide, at the registration time of the authentication information, which one of the usual mode and the quiet-sound mode to relate to the authentication information as the default mode. And, when authenticating the user who inputs the identification information, the main control portion 110 sets the default mode, which corresponds to the authentication information that is the basis of the authentication, as the job executing mode.

According to this structure, in the case where the user is authenticated when using the image forming apparatus 100, the job executing mode set at the authentication time is the job executing mode that is registered beforehand by the authenticated user; accordingly, the convenience for the user improves.

In the meantime, in the case where the image forming apparatus 100 incorporates the user authenticating function, a structure may be employed, in which authorization for setting and changing the job executing mode is given to an supervisor only who supervises the image forming apparatus 100; and general users other than the supervisor are prohibited from setting and changing the job executing mode. Or, only authorization for setting and changing the job executing modes for the plurality of kinds of functions in the function unit may be given to general users, or only authorization for setting and changing the job executing mode of the executing target job in the executing target job unit may be given to general users.

(Driving Control of Fan Based on Job Executing Mode)

The main control portion 110 makes driving periods (periods for continuous driving after the job ends) of the fan 100F different from each other in the case where the job executing mode is set to the usual mode and in the case where the job executing mode is set to the quiet-sound mode. Specifically, the fan 100F is continuously driven after the job ends for a period that is shorter in the case where the job executing mode is the quiet-sound mode than in the case where the job executing mode is the usual mode. According to this structure, the quietness during the time of the quiet-sound mode rises further.

It should be considered that the embodiments disclosed this time are examples in all respects and are not limiting. The scope of the present disclosure is not indicated by the above description of the embodiments but by the claims, and all modifications within the scope of the claims and the meaning equivalent to the claims are covered.

What is claimed is:

1. An image forming apparatus that incorporates two job executing modes of: a usual mode for executing a job at a predetermined usual processing speed; and a quiet-sound mode for raising quietness during a time of executing a job by executing the job at a quiet-sound processing speed slower than the usual processing speed, the image forming apparatus comprising:

a job executing portion that executes jobs of a plurality of kinds of functions, uses the usual processing speed as a processing speed in the usual mode, and uses the quiet-sound processing speed as a processing speed in the quiet-sound mode;

a mode setting portion that sets in which one of the job executing modes of the usual mode and the quiet-sound mode to execute a job; and an operating portion that accepts an operation for setting the job executing mode; wherein the operating portion accepts a function unit setting operation for setting the job executing mode in a function unit;

when the operating portion accepts the function unit setting operation, the mode setting portion sets the job executing mode in the function unit based on the function unit setting operation accepted by the operating portion; and the job executing portion executes a job in the job executing mode set by the mode setting portion;

wherein:

the operating portion includes a display portion provided with a touch panel, makes the display portion display a mode setting key that has a usual mode key for performing setting or changing to the usual mode and a quiet-sound mode key for performing setting or changing to the quiet-sound mode for each of the plurality of kinds of functions, and accepts an operation for touching the mode setting key as the function unit setting operation; and when the function unit setting operation is performed on the mode setting key, if the usual mode key is an operation target, the mode setting portion sets the iob executing mode for the function, which corresponds to the mode setting key on which the function unit setting operation is performed, to the usual mode, and if the quiet-sound mode key is an operation target, the mode setting portion sets the job executing mode for the function, which corresponds to the mode setting key on which the function unit setting operation is performed, to the quiet-sound mode;

in the case where a multi-function achieved by a combination of two or more of the plurality of kinds of functions exists, the operating portion displays the two or more mode setting keys, which respectively correspond to the two or more functions that compose the multi-function, in a display region for the mode setting key that corresponds to the multi-function;

the operating portion sets a display form of the usual mode key of the mode setting key, which corresponds to the function set to the usual mode, to a first display form, sets a display form of the quiet-sound mode key to a second display form that is different from the first display form, on the other hand, sets the display form of the quiet-sound mode key of the mode setting key, which corresponds to the function set to the quiet-sound mode, to the first display form, and sets the display form of the usual mode key to the second display form; and the operating portion makes the display portion display apparatus images of the image forming apparatus, when making the display portion display the apparatus images, the operating portion sets a display form of a portion for achieving the function set to the usual mode to a third display form, and sets a display form of a portion for achieving the function set to the quiet-sound mode to a fourth display form that is different from the third display form.

2. The image forming apparatus according to claim 1, wherein in a case where the multi-function achieved by the combination of two or more functions of the plurality of kinds of functions exists, the operating portion accepts the function unit setting operation for every two or more functions that compose the multi-function as to the multi-function.

3. The image forming apparatus according to claim 1, wherein the operating portion makes the display form of the usual mode key when displaying the usual mode key in the first display form and the display form of the quiet-sound mode key when displaying the quiet-sound key in the first display form different from each other.

4. The image forming apparatus according to claim 1, wherein the operating portion accepts an operation for touching a display region for the apparatus image as the function unit setting operation; and when the function unit setting operation is performed on the display region for the apparatus image, the mode setting portion sets the job executing mode for the function achieved by a portion located in the display region for the apparatus image on which the function unit setting operation is performed.

5. The image forming apparatus according to claim 1, wherein the operating portion accepts a concurrent changing operation for concurrently changing all the job executing modes of the plurality of kinds of functions into a same one of the job executing modes; and when the operating portion accepts the concurrent changing operation, the mode setting portion concurrently changes all the job executing modes of the plurality of kinds of functions into the same one of the job executing modes based on the concurrent changing operation received by the operating portion.

6. The image forming apparatus according to claim 1, wherein the job executing portion includes an image forming portion that forms an image and prints the image on a paper sheet and a paper sheet supplying portion that supplies the paper sheet to the image forming portion, wherein in a case where the paper sheet supplying portion is disposed in a plurality of stages in the image forming apparatus, the operating portion accepts an operation for setting the job executing mode in a unit of the paper sheet supplying portion as to the function that uses the paper sheet supplying portion.

7. The image forming apparatus according to claim 1, wherein the operating portion makes the display portion display an icon which indicates, in a visually identifiable manner, whether the job executing mode set by the mode setting portion is the usual mode or the quiet-sound mode.

8. The image forming apparatus according to claim 1, wherein the operating portion makes the display portion display sound information that indicates how much a sound level released during a job executing time changes when the job executing mode is changed.

9. An image forming apparatus that incorporates two job executing modes of: a usual mode for executing a job at a predetermined usual processing speed; and a quiet-sound mode for raising quietness during a time of executing a job by executing the job at a quiet-sound processing speed slower than the usual processing speed, the image forming apparatus comprising:

a job executing portion that executes lobs of a plurality of kinds of functions, uses the usual processing speed as a processing speed in the usual mode, and uses the quiet-sound processing speed as a processing speed in the quiet-sound mode;

a mode setting portion that sets in which one of the job executing modes of the usual mode and the quiet-sound mode to execute a job; and an operating portion that accepts an operation for setting the job executing mode; wherein the operating portion accepts a function unit setting operation for setting the job executing mode in a function unit;

when the operating portion accepts the function unit setting operation, the mode setting portion sets the job executing mode in the function unit based on the function unit setting operation accepted by the operating portion; and the job executing portion executes a job in the job executing mode set by the mode setting portion a storage portion that stores either one of the usual mode and the quiet-sound mode as a default mode, and a power source portion that is a portion which performs power supply for a power supplied portion that includes the job executing portion and the mode setting portion, performs usual power supply for the power supplied portion in a usual power mode, and restricts the power supply for the power supplied portion in a power saving mode more than in the usual power mode, wherein the mode setting portion sets the default mode stored in the storage portion as the job executing mode at a startup time of the image forming apparatus, the operating portion accepts an operation for setting whether to prohibit a shift from the usual power mode to the power saving mode or not, and when the operating portion accepts information of prohibiting the shift from the usual power mode to the power saving mode, the storage portion stores the usual mode as the default mode, and when the operating portion accepts information of permitting the shift from the usual power mode to the power saving mode, the storage portion stores the quiet-sound mode as the default mode.

10. An image forming apparatus that incorporates two job executing modes of: a usual mode for executing a job at a predetermined usual processing speed; and a quiet-sound mode for raising quietness during a time of executing a job by executing the job at a quiet-sound processing speed slower than the usual processing speed, the image forming apparatus comprising:

a job executing portion that executes jobs of a plurality of kinds of functions, uses the usual processing speed as a processing speed in the usual mode, and uses the quiet-sound processing speed as a processing speed in the quiet-sound mode;

a mode setting portion that sets in which one of the job executing modes of the usual mode and the quiet-sound mode to execute a job; and an operating portion that accepts an operation for setting the job executing mode; wherein the operating portion accepts a function unit setting operation for setting the job executing mode in a function unit;

when the operating portion accepts the function unit setting operation, the mode setting portion sets the job executing mode in the function unit based on the function unit setting operation accepted by the operating portion; and the job executing portion executes a job in the job executing mode set by the mode setting portion;

a storage portion that stores either one of the usual mode and the quiet-sound mode as a default mode, wherein the mode setting portion sets the default mode stored in the storage portion as the job executing mode at a startup time of the image forming apparatus, if a job executing frequency in the usual mode during a predetermined period is higher than a job executing frequency in the quiet-sound mode during the predetermined period, the storage portion stores the usual mode as the default mode, and if the job executing frequency in the quiet-sound mode during the predetermined period is higher than the job executing frequency in the usual mode during the predetermined period, the storage portion stores the quiet-sound mode as the default mode.

11. An image forming apparatus that incorporates two job executing modes of: a usual mode for executing a job at a predetermined usual processing speed; and a quiet-sound mode for raising quietness during a time of executing a job by executing the job at a quiet-sound processing speed slower than the usual processing speed, the image forming apparatus comprising:

a job executing portion that executes jobs of a plurality of kinds of functions, uses the usual processing speed as a processing speed in the usual mode, and uses the quiet-sound processing speed as a processing speed in the quiet-sound mode;

a mode setting portion that sets in which one of the job executing modes of the usual mode and the quiet-sound mode to execute a job; and an operating portion that accepts an operation for setting the job executing mode; wherein the operating portion accepts a function unit setting operation for setting the job executing mode in a function unit;

when the operating portion accepts the function unit setting operation, the mode setting portion sets the job executing mode in the function unit based on the function unit setting operation accepted by the operating portion; and the job executing portion executes a job in the job executing mode set by the mode setting portion;

a fan that is driven during a job executing time, wherein the fan is continuously driven after a job ends for a time that is shorter in a case where the job executing mode is the quiet-sound mode than in a case where the job executing mode is the usual mode.

12. An image forming apparatus that incorporates two job executing modes of: a usual mode for executing a job at a predetermined usual processing speed; and a quiet-sound mode for raising quietness during a time of executing a job by executing the job at a quiet-sound processing speed slower than the usual processing speed, the image forming apparatus comprising:

a job executing portion which executes a job at the usual processing speed in the usual mode and executes a job at the quiet-sound processing speed in the quiet-sound mode;

a mode setting portion which sets in which one of the job executing modes of the usual mode and the quiet-sound mode to execute a job; and an operating portion which accepts an operation for setting the job executing mode; wherein during at least one period of a job executing period when an executing target job is under execution and a job standby period when the executing target job is on standby, the operating portion accepts a job unit setting operation for setting, in a unit of the executing target job, the job executing mode of the executing target job that is at least one job of a job under execution and a standby job;

when the operating portion accepts the job unit setting operation, the mode setting portion sets the job executing mode in the unit of the executing target job based on the job unit setting operation accepted by the operating portion; and the job executing portion executes a job in the job executing mode set by the mode setting portion;

the operating portion includes a display portion provided with a touch panel, makes the display portion display a mode setting key that has a usual mode key for performing setting or changing to the usual mode and a quiet-sound mode key for performing setting or changing to the quiet-sound mode during at least one period of the job executing period and the iob standby period, and accepts an operation for touching the mode setting key as the job unit setting operation; and when the job unit setting operation is performed on the mode setting key, if the usual mode key is an operation target, the mode setting portion sets the iob executing mode of the executing target job to the usual mode, and if the quiet-sound mode key is an operation target, the mode setting portion sets the job executing mode of the executing target job to the quiet-sound mode;

in a case where a plurality of the executing target jobs exist, the operating portion accepts the job unit setting operation in the unit of the executing target job by displaying a plurality of the mode setting keys that respectively correspond to the plurality of the executing target lobs;

when the operating portion accepts the job unit setting operation during the job executing period when the executing target job is being executed, the mode setting portion stops temporarily the executing target job under execution and changes the job executing mode of the executing target job.

13. The image forming apparatus according to claim 12, wherein during at least one period of the job executing period and the job standby period, the operating portion displays a job executing situation screen that indicates an executing situation of the executing target job and displays the mode setting key in the job executing situation screen.

14. The image forming apparatus according to claim 12, wherein the operating portion makes the display portion display an icon which indicates, in a visually identifiable manner, whether the job executing mode set by the mode setting portion is the usual mode or the quiet-sound mode.

* * * * *